US007628709B2

(12) United States Patent
Johnson

(10) Patent No.: US 7,628,709 B2
(45) Date of Patent: Dec. 8, 2009

(54) MINI-FACE BLADE PUTTER

(75) Inventor: Lanny Leo Johnson, 4658 Chippawa Dr., Okernos, MI (US) 48864

(73) Assignee: Lanny Leo Johnson, Okernos, MI (US)

( * ) Notice: Subject to any disclaimer, the term of this patent is extended or adjusted under 35 U.S.C. 154(b) by 0 days.

(21) Appl. No.: 10/572,672

(22) PCT Filed: Sep. 10, 2004

(86) PCT No.: PCT/US2004/029728

§ 371 (c)(1),
(2), (4) Date: Sep. 18, 2008

(87) PCT Pub. No.: WO2005/032661

PCT Pub. Date: Apr. 14, 2005

(65) Prior Publication Data

US 2009/0011853 A1 Jan. 8, 2009

(51) Int. Cl.
*A63B 53/04* (2006.01)

(52) U.S. Cl. ..... 473/313; 473/328; 473/330; 473/340

(58) Field of Classification Search ..... 473/313, 473/246, 341, 328, 334, 335, 339, 325, 330, 473/241, 244, 248, 251, 340
See application file for complete search history.

(56) References Cited

U.S. PATENT DOCUMENTS 2,332,342 A 10/1943 Reach
3,333,854 A * 8/1967 White ..... 473/288

(Continued)

FOREIGN PATENT DOCUMENTS

JP 07275412 10/1995

(Continued)

*Primary Examiner*—Stephen L. Blau
(74) *Attorney, Agent, or Firm*—Gallagher & Dawsey Co., LPA; Michael J. Gallagher; David J. Dawsey

(57) ABSTRACT

A method of fitting a golf putter to an individual golf stroke of a person which comprises the steps of:

(a) providing a golf putter to a person comprising a shaft with a proximal end and a distal end, an attachment means for pivotably attaching a putter head to the distal end of the shaft, an elongate flat blade having opposed ends and a top side and a bottom side and pivotably attached on the top side to the attachment means allowing for selection of a desired angle of the blade relative to the shaft, one or more weights removably connected to the elongate flat blade, and an adjustable runner having a height and attached to the bottom side of the elongate flat blade;

(b) determining the golf stroke of the person;

(c) adjusting a runner height to the golf stroke of the person;

(d) weighting the putter with the one or more weights to set a center of mass of the head to a point behind a contact area of the blade with a golf ball, particular to the golf stroke of the person;

(e) pivoting the shaft with respect to the elongate flat blade at a pivot angle to allow the blade to remain parallel to the ground for the particular golf stroke of the person; and (f) measuring the runner height, the one or more weights, and the desired angle for the purpose of fitting the putter to the particular golf stroke of the person.

7 Claims, 18 Drawing Sheets

U.S. PATENT DOCUMENTS 4,529,202 A 7/1985 Jacobson
4,846,477 A * 7/1989 Phelan ..... 473/330
D303,825 S 10/1989 Burns
5,388,827 A 2/1995 Reynolds, Jr.
5,467,987 A * 11/1995 Perkins et al. ..... 473/340
5,580,051 A 12/1996 Fisher
D387,828 S * 12/1997 Reina ..... D21/746
6,520,865 B1 * 2/2003 Fioretti ..... 473/251

FOREIGN PATENT DOCUMENTS

JP 08150233 6/1996

* cited by examiner

MINI-FACE BLADE PUTTER

CROSS-REFERENCE TO RELATED APPLICATIONS

None

STATEMENT REGARDING FEDERALLY SPONSORED RESEARCH OR DEVELOPMENT

Not Applicable

REFERENCE TO A "COMPUTER LISTING APPENDIX SUBMITTED ON A COMPACT DISC"

Not Applicable

BACKGROUND OF THE INVENTION (1) Field of the Invention

The present invention relates generally to golf equipment, and more particularly to golf putters. Specifically, the present invention relates to a golf putter head having an elongate flat blade for contacting the golf ball. More specifically, the invention relates to a golf putter head which has a contact area between the blade and the golf ball which is linear, of narrow width, and which has a contact area that is essentially horizontal and which spans the dimple diameter of the ball.

(2) Description of the Related Art

The traditional putter has a vertical blade with a flat surface and a vertical height usually one inch (25 mm) or greater. Subsequent traditional putters have a similar geometry on the face allowing for flat, convex, but not concave faces. The contact surface is often distinguished by the shape of the mass behind the vertical face. There have been putters with curved contact faces from heel to toe on the putter. This feature is permissible under United States Golf Association (U.S.G.A.) rules. There also have been putters that are totally cylindrical in geometry. Existing putters come in many sizes and geometries. There is often heel to toe weighting to resist the turning of the vertical positioned putter blade.

The rules of golf equipment are controlled by the U.S.G.A. for America. The Royal and Ancient Golf Club of St. Andrews (R.&A.) is the governing authority for the rules of golf in more than one hundred affiliated nations. More recently, in a written 'statement of principles' published jointly by the R.&A. and the U.S.G.A., it was acknowledged that, "History has proved that it is impossible to foresee the developments in golf equipment which advancing technology will deliver." However, both the R.&A. and the U.S.G.A. remain vigilant when considering the equipment rules. The main objective of U.S.G.A. Rules 4 and 5 and Appendices II and III is to protect golf's best traditions, to prevent an over-reliance on technological advances rather than skill, and to ensure that skill is the dominant element of success throughout the game. Therefore, any club design must consider these rules if the club is to be deemed legal by the governing authorities of golf. Any putter must be compatible with the U.S.G.A. rules of golf in regards to being plain in shape, with runners that do not extend into the face, a width that is greater than the depth, a face without concavity, a face angle of no more than fifteen degrees, and an angle of shaft to the head of ten degrees incline or greater. There is no rule regarding the vertical depth of the face of the putter.

U.S. Pat. No. 3,730,529 to Donofrio teaches a stroke indicating golf club operable for visually presenting the area of contact of the club head with the golf ball. The club can also be used for normal golfing. The club has a plurality of pins extending forward and backward through the club head which are displaced physically upon contact with the ball to retain a contact impression of the golf ball with the club head.

U.S. Pat. No. 4,165,076 to Cella teaches a putter with the blade face formed with a longitudinal edge, which is the normal ball striking component of the golf club, being located above the center line of the ball in blade striking position. On the reverse side of the blade there is provided a secondary ball striking edge located below the center line of the ball.

U.S. Pat. No. 5,294,122 to Longo teaches a golf putter having a head designed to function effectively, both on the green and on the fringe as well as in the higher grass areas. The head has a rectangular body with a flat base formed with comb-like longitudinal ridges or runners which serve to part grass blades during forward and backward movement. The head is a horizontal, upwardly positioned ball striking surface and has a downwardly tapered top surface having a ball pick-up socket at its rear edge.

U.S. Pat. No. 5,467,987 to Perkins et al. teaches a golf putter having a club head with a striking face comprising a striking edge defined by at least two substantially planar surfaces which engages a golf ball at a point below the center of the golf ball.

U.S. Pat. No. 5,531,439 to Azzarella teaches a putter for imparting rotation to a golf ball during putting. The putter includes a club handle with a sole plate attached to a lower end thereof. A face plate projects from a forward edge of the sole plate and is oriented at an orthogonal angle relative to the plate. A frictional insert is mounted within a slot of the face plate and operates to impart a rotation to the ball during contact.

U.S. Pat. No. 5,542,675 to Micciche et al. teaches a golf putter head adaptor for providing a putter head with an elastomeric striking surface. The adaptor includes a central portion adapted to cover a substantial portion of the striking surface of a putter head, an upper lip portion adapted to engage the top surface of a putter head and a bottom lip portion adapted to engage the bottom surface of a putter head. The adaptor also includes an elastomeric portion associated with the central portion of the attachment layer such that it covers a sufficient portion of the striking surface of the putter head to allow the striking of a golf ball exclusively with the elastomeric portion of the striking surface. Micciche et al. also teach a putter including the putter head adaptor and a snap-on putter head adaptor for providing an elastomeric striking surface to a putter head. The putter head adaptor can be employed to adapt an existing putter to provide it with an elastomeric striking surface and it can be removed and exchanged in order to adapt the putter to the prevailing playing conditions.

U.S. Pat. No. 5,718,644 to Donofrio teaches an insert member for a golf putter. One face of the insert is adapted to fittingly engage the putting face of a head of the golf putter. The other face of the insert, which engages the golf ball, comprises a regular, elongated, curved surface such as an arc section of a cylinder. The elongated curved surface is longitudinally positioned in alignment with a longitudinal axis of the putter head and is preferably of a dimension and position for putting engagement with a golf ball below the equator of the ball. The insert is comprised of titanium, titanium alloy, anodized aluminum, or high strength plastic.

U.S. Pat. No. 6,155,934 to Pinns teaches a putter. In one form, the club has a head with a ground engaging surface and a ball striking surface and an elongate shaft which is connected to the head. The ball striking surface extends upwardly from the ground engaging surface a predetermined distance that is no more than 0.8 inches (20.3 mm).

U.S. Pat. No. 6,270,423 to Webb teaches a golf club head with interchangeable pads or inserts, each of which is composed of material having a different density. The mounting face detachably anchors or holds the selected pad or insert in place by screws, clips, adhesive or the like. Guides are provided on the club head for aligning the pad or insert with the mounting face.

U.S. Pat. No. 6,340,336 to Loconte teaches a putter head for a golf club designed to strike the upper portion only of a golf ball. The club face has an upper vertical face and a lower face constructed at such an angle away from the golf ball so as to prevent contact with the lower part of the golf ball. Additionally, the shaft connects to the club head on the side of the club head for right or left handed golfers. Alternatively, the shaft connects intermediate of the club head having grooves therein for insertion of weights onto the upper leading and trailing edges of the putter head for balancing the putter head.

U.S. Pat. No. 6,450,894 to Sun et al. teaches a golf putter head having a central portion made of a relatively light weight material such as a light alloy of extruded aluminum or extruded plastic alloy. The central portion can be extruded. The face plate can be formed from a light polymer or rubber material. The toe and heel portions of the head are separately formed of a relatively heavy material such as sintered tungsten or tungsten copper. The toe and heel portions are similar to each other and are attached to the central portion by means of pins as well as screws which engage threads formed in the central portion. Employing a central portion which is much lighter in weight than the end portions provides an anti-twisting motion of inertia to the club head.

U.S. Pat. No. 6,464,598 to Miller teaches a golf club with a wedge face, a rounded sole, and a putting face located along a blade area between the wedge face and a front portion of the rounded sole. The putting face is located at a height above the crown of the rounded sole so that the putting face strikes a golf ball above the equator of the ball to impart top spin when putting.

U.S. Pat. No. 6,517,450 to Klyve teaches a golf club of the putter type, with a club head with a level, vertical or largely vertically positioned strike area. The strike area is arranged as a lengthwise extended tension bar, which is clamped to two fastening clamps at the opposite ends of the club head. The tension bar has, in an area between the two opposite end parts, a main part which extends freely over a hollow in the club head.

U.S. Pat. No. 6,520,865 to Fioretti teaches a golf putter which has a vertical arcuate striking face wherein the height of the striking face is at least as high as the diameter of a golf ball. The arcuate face is preferably in the shape of the contour of a golf ball. The putter head has a top surface with a top face edge, a bottom surface with a bottom face edge, rear and opposing edge faces and a vertical arcuate striking face extending from the bottom face edge to the top face edge so that the top face edge overhangs the bottom face edge.

U.S. Pat. No. 6,524,193 to Devore teaches a golf putter head which has a cylindrical body with a defined flat face on top. The body is made up of an outer shell of an aluminum alloy and an inner core of brass. The head has a groove across the flat face of the top and at its center, with indicator material carried in the groove for alignment purposes. The head is sized so that the convex surface of the cylindrical body, at its widest point, will strike a golf ball at its corresponding widest point.

U.S. Pat. No. 6,533,678 to Johnson teaches a golf putter that has an interchangeable striking face, while maintaining the same head, shaft and grip. The various striking faces are made of different materials with different rebound characteristics.

U.S. Pat. No. 6,554,721 to Woodward et al. teaches a golf club head comprising a main body that defines a front face. The front face includes projections extending from the front face. The ends of the projections define a plurality of individual contact surfaces for striking a golf ball. The projections prevent a golf ball from contacting the front face thereby resulting in a change of the golf ball general contact area.

U.S. Design Pat. No. D396257 to Spano teaches an ornamental design for a golf club head. It is not clear from the drawings how the club is used.

The physics of the putter contact area with the golf ball is important in the development of a golf putter. It is germane to this description to review the physics of the putter contact area with the golf ball. The typical force of impact during putting results in little or no deformation of the ball in contrast to the impact imparted by other golf clubs, especially the driver. Therefore, the contact area results in minimal deformation of the ball. The contact is limited to the surface of the golf ball and does not progress to the base of the golf ball's dimples. The striking face of the putter whether curved or perfectly straight makes less than 0.125 $in^2$ (80.6 $mm^2$) of contact with the spherical golf ball. The geometry of the contact area is circular whether created with a flat or curved, putter face. It would be coincidental if the area contacted by the blade of the ball symmetrically surrounded any single dimple to produce an even surface of contact. The usual contact area is varied and is rarely symmetrical. The perfect circular contact area would allow the resultant direction to be along any of the 360°. The asymmetrical contact area also possibly has a resultant angular direction force depending upon how the blade contacted the irregular surface of the golf ball.

While the related art describes alternative ways to address improving putter performance, there is still a need for a superior solution.

OBJECTS

Therefore, it is an object of the present invention to provide an improved putter. It is further an object of the present invention to provide a putter with a geometry such that the contact area between the putter and the ball at impact is linear and essentially horizontal. It is further an object of the present invention to provide a putter which determines the contact point with the ball, the angle of approach, and the swing arc of the player and optimum roll of the bail. These and other objects will become increasingly apparent by reference to the following description and the drawings.

SUMMARY OF THE INVENTION

The present invention provides a golf putter having a shaft with a grip at a proximal end and a head at a distal end of the shaft for contacting a golf ball on the ground during putting of the golf ball, the improvement in the head which comprises: an elongate flat blade having opposed ends (toe and heel edges), with a top side and a bottom side, and a first linear edge (front edge) extending therebetween, wherein the top side of the blade is mounted on the distal end of the shaft and the first linear edge (front edge) acts as a striking face for the golf ball and strikes the golf ball in an essentially linear contact area horizontal to the ground.

In further embodiments, the head of the previous embodiment is configured to optimally align the putter face to the ball along a horizontal central axis of the ball. In still further embodiments, the striking face is sharp, pointed, flat, or curved. In still further embodiments a single groove extends along a length of the striking face. In still further embodiments the striking face is curved with a radius of curvature less than a radius of the golf ball. In still further embodiments the striking face is capable of striking the golf ball at, above, or below a median of the golf ball.

The present invention further provides a golf putter having a shaft with a grip at a proximal end and a head at a distal end of the shaft for contacting a golf ball on the ground during putting of the golf ball, the improvement in the head which comprises: an elongate flat blade having opposed ends (toe and heel edges), with a top side and a bottom side, and a first linear edge (front edge) extending therebetween, wherein the top side of the blade is mounted on the distal end of the shaft and the first linear edge (front edge) acts as a striking face for the golf ball and strikes the golf ball in an essentially linear contact area horizontal to the ground; and a runner provided on the bottom side of the blade wherein during putting, the runner acts to space the bottom side of the blade from the ground. In some embodiments the runner extends between the first linear edge and a second linear edge (back edge), and is convexly rounded between the linear edges. In further embodiments, a bottom of the head is convexly rounded between the ends of the blade. In still further embodiments, the weights of any of the previous embodiments are variously mounted on the head which act to stabilize the head during putting. The weights can vary to change the center of gravity of the putter for a particular individual. In still further embodiments, the bottom of the head of any of the previous embodiments is provided with a convexly rounded semicircular or ovate protrusion from the blade as the runner. In still further embodiments, the head of any of the previous embodiments is metal or other suitable material. In still further embodiments, the blade of any of the previous embodiments is metal and with a non-metal on the sides of the blade. In still further embodiments the shaft of the putter is mounted on the top side of the blade. In still further embodiments, the shaft of the putter in of any of the previous embodiments is mounted on the top side of the blade adjacent to the point on the first linear edge (front edge) where the edge strikes the golf ball. In other embodiments it can be mounted anywhere on the horizontal blade which strikes the ball without any interpositioned material which modifies the striking face. In still further embodiments, the striking face of any of the previous embodiments is preferably less than about 0.25 inch (6.4 mm) thick between the sides defining the linear edge. In still further embodiments, the head of any of the previous embodiments is configured to optimally align the putter face to the ball along a horizontal central axis of the ball. In still further embodiments, the striking face of any of the previous embodiments is sharp, pointed, flat, or curved. In still further embodiments a single groove extends along a length of the striking face. In still further embodiments the striking face is curved with a radius of curvature less than a radius of the golf ball. In still further embodiments the striking face is capable of striking the golf ball at, above, or below a median of the golf ball.

The present invention further provides a modular putter head for attachment to a head of an existing putter which comprises an elongate flat blade with a first linear edge (front edge) extending between ends of the blade and top and bottom sides of the blade, and forming a striking face for a golf ball, which during putting strikes the ball in an essentially linear, horizontal line of contact, and with a second linear edge parallel to the first linear edge and extending between the ends of the blade; and an attachment means for securing the blade to the head of the putter. The runner can be modular as well so as to be replaceable to accommodate individual golfer's stroke. In further embodiments of the modular putter head, a bottom of the sides of the putter head provides a runner which is adjacent to the ground and a top of the sides is attached to the shaft. There does not need to be a runner. If there is a runner it can be as fins which are as fins for instance on the underside of the putter in the direction of the put to promote a straight strike. In further embodiments of the modular putter head the runner is narrow and convexly curved, so that in use the runner minimizes skidding against the ground.

The present invention further provides a method of training a golfer to perfect a stroke for putting a golf ball which comprises gripping a golf putter having a shaft with a grip at a proximal end and a head for contacting the ball during putting at a distal end of the shaft, for putting a golf ball, the improvement in the head which comprises an elongate flat blade with a first linear edge (front edge) as a striking face for the golf ball between ends of the blade and parallel sides of the blade, which edge during putting strikes the ball in an essentially linear horizontal line of contact, and with a second linear edge parallel to the first edge between the ends of the blade, and stroking the ball repeatedly with the putter in order to perfect the stroke for putting of the golf ball. In some embodiments of the method, a bottom of the sides (bottom side) provides a runner which is adjacent to the ground and a top of the sides (top side) is attached to the shaft.

The present invention further provides a golf putter for fitting to an individual golf stroke comprising a shaft with a proximal end and a distal end; an attachment means for pivotably attaching a putter head to the distal end of the shaft; an elongate flat blade having opposed ends and a top side and a bottom side, and pivotably attached on the top side to the attachment means allowing for selection of a desired angle of the blade relative to the shaft; one or more weights removably connected to the elongate flat blade; and an adjustable runner having a height and attached to the bottom side of the elongate flat blade. In further embodiments the weights are attached to the opposed ends of the blade.

The present invention further provides a method of fitting a golf putter to an individual golf stroke of a person which comprises the steps of providing a golf putter to a person comprising a shaft with a proximal end and a distal end, an attachment means for pivotably attaching a putter head to the distal end of the shaft, an elongate flat blade having opposed ends and a top side and a bottom side and pivotably attached on the top side to the attachment means allowing for selection of a desired angle of the blade relative to the shaft, one or more weights removably connected to the elongate flat blade, and an adjustable runner having a height and attached to the bottom side of the elongate flat blade; determining the golf stroke of the person; adjusting a runner height to the golf stroke of the person; weighting the putter with the one or more weights to set a center of mass of the head to a point behind a contact area of the blade with a golf ball, particular to the golf stroke of the person; pivoting the shaft with respect to the elongate flat blade at a pivot angle to allow the blade to remain parallel to the ground for the particular golf stroke of the person; and measuring the runner height, the one or more weights, and the desired angle for the purpose of fitting the putter to the particular golf stroke of the person.

DETAILED DESCRIPTION OF THE INVENTION

All patents, patent applications, government publications, government regulations, and literature references cited in this specification are hereby incorporated herein by reference in their entirety. In case of conflict, the present description, including definitions, will control. Definitions for the following terms are provided to promote a further understanding of the present invention.

The term "contact area" is the area on either the blade or the ball where there is contact between the ball and the putter blade.

The term "proximal" refers to the side near the golfer.

The term "distal" refers to the side away from the golfer.

The term "front" refers to the side of the putter head used as a striking face which contacts the golf ball.

The term "toe" refers to the side (end) of the putter head which is away from the golfer when putting.

The term "heel" refers to the side (end) of the putter head which is near the golfer when putting.

Figure 1:
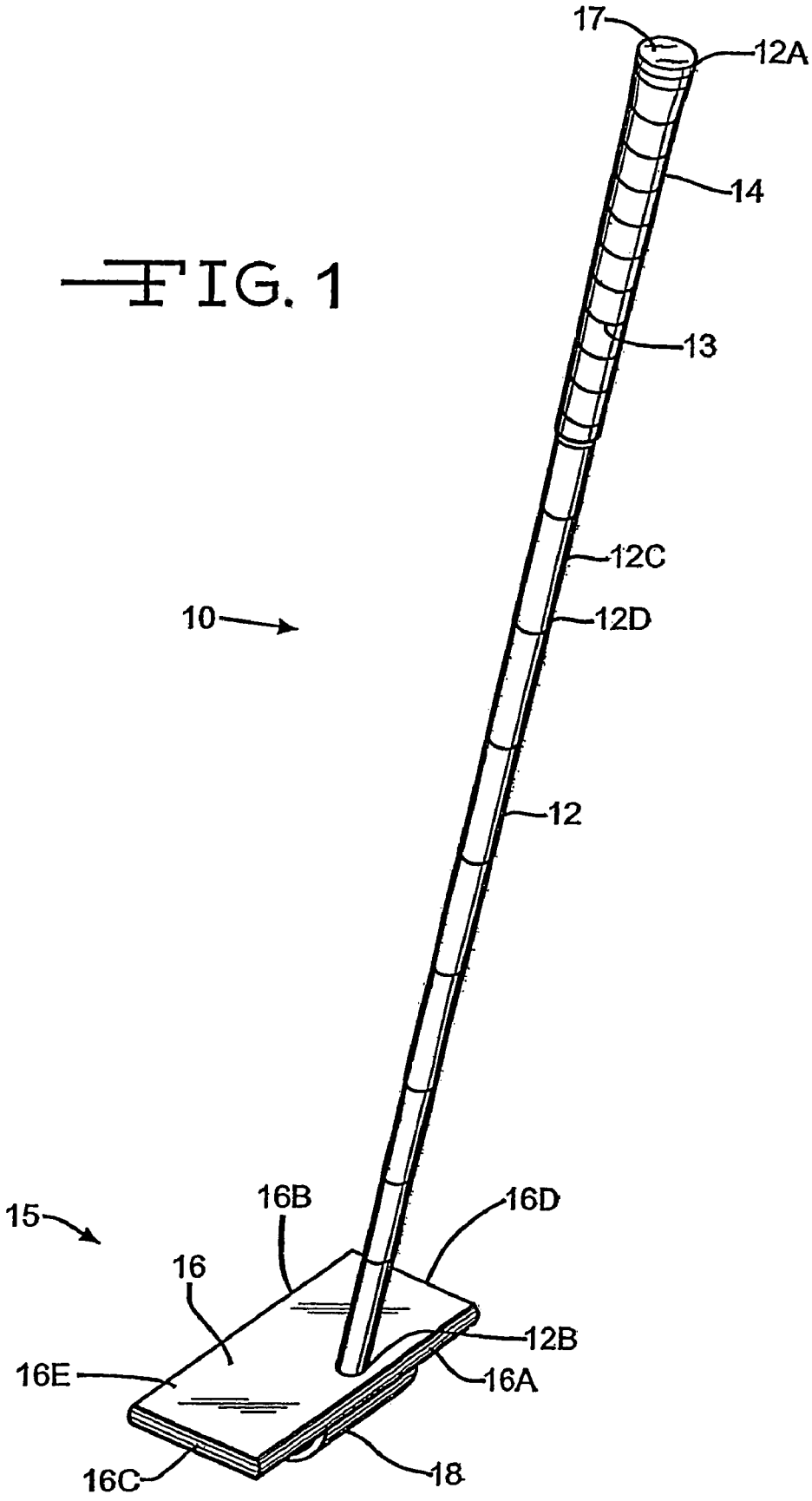
FIG. 1 illustrates a perspective view of an embodiment of an elongate flat blade golf putter 10 according to the present invention.

FIG. 1 illustrates a perspective view of an embodiment of a golf putter 10 according to the present invention. The golf putter 10 includes a shaft 12 with a proximal end 12A and a distal end 12B, and a head 15 mounted on the distal end 12B of the shaft 12. In one embodiment, the shaft 12 is straight and constructed of chrome plated, connected, concentric steel cylinders 12C as shown in FIG. 1. Adjacent concentric steel cylinders 12C narrowing in radius from the proximal end 12A towards the distal end 12B of shaft 12, thereby creating a shaft 12 which tapers down from the proximal end 12A to the distal end 12B of the shaft 12. The resulting outward appearance of the shaft 12, is of smooth cylinders 12C which have smooth narrowing steps 12D at the distal ends of each steel cylinder 12C. In other embodiments, the shaft 12 is a single-piece smoothly tapered stainless steel, graphite or any other suitable material. Further embodiments of the shaft 12 can be any shaft design known in the art. In some embodiments, the shaft 12 can be straight from the proximal end 12A of shaft 12 to within approximately 5.0 inches (127 mm) or fewer above the distal end 12B of the shaft 12.

A grip 14 is located at the proximal end of the shaft 12 which allows a golf player to maintain a firm hold on the club. The grip 14 material is constructed of a wrapped leather strip, and has a circular cross section of approximately 1.75 inches (44.5 mm) or less when applied to the shaft 12. The resulting grip 14 has a slightly indented spiral 13 upward towards the proximal end 12A of shaft 12, where a small rubber cap 17 is inserted. In other embodiments, the grip 14 is constructed of rubber and has a non-circular cross-section without bulges or waists. In further embodiments, the grip 14 can have a continuous, straight, slightly raised rib along the full length of the grip 14. In further still embodiments, the putter 10 will have two grips 14 circular in cross-section, with both grips coaxial with the shaft 12, separated by at least approximately 1.5 inches (38 mm). However, any legal grip 14 known in the art can be used which fits the proximal end 12A of the shaft 12.

The head 15 includes an elongate flat blade 16 and a runner 18. The elongate flat blade 16 includes a first linear edge as a front edge 16A, and a second linear edge as a back edge 16B, a toe edge 16C, a heel edge 16D, a top side 16E, and a bottom side 16F. The top side 16E and bottom side 16F are parallel sides of the blade. A runner 18 is attached to the bottom side 16F of the blade 16. The runner has an inner surface 18A, an outer surface 18B, a front end 18C, and a back end 18D. The front edge 16A of the blade 16 is the striking face for contacting the golf ball 20 between the ends defined by toe edge 16C and heel edge 16D, and the parallel sides of the top side 16E and bottom side 16F. The distal end 12B of shaft 12 is attached to the top side 16E of blade 16 such that the projection of the shaft 12 onto the vertical plane through the front edge 16A of the blade 16 is 10° or more. In further embodiments, the shaft 12 is attached to the blade 16 such that the projection of the shaft 12 upon a vertical plane through the toe edge 16C of the blade 16 is 20° or less. The elongate flat blade 16 is attached to the distal end 12B of the shaft 12 near front edge 16A at the center of the length of front edge 16A between toe edge 16C and heel edge 16D. The distal end 12B of shaft 12 is attached to the blade 16 at or near the area of anticipated contact of the blade 16 to the ball. In other embodiments, the shaft 12 is attached to the top side 16E of the blade 16 through a single plain neck or socket. The length along the neck or socket axis in these embodiments, following any bends, is approximately 5.0 inches (127 mm) or less. The overall length of the putter 10 from proximal end 12A of the shaft 12 to the outer surface 18B of runner 18 is at least approximately 18 inches (457 mm).

Figure 2:
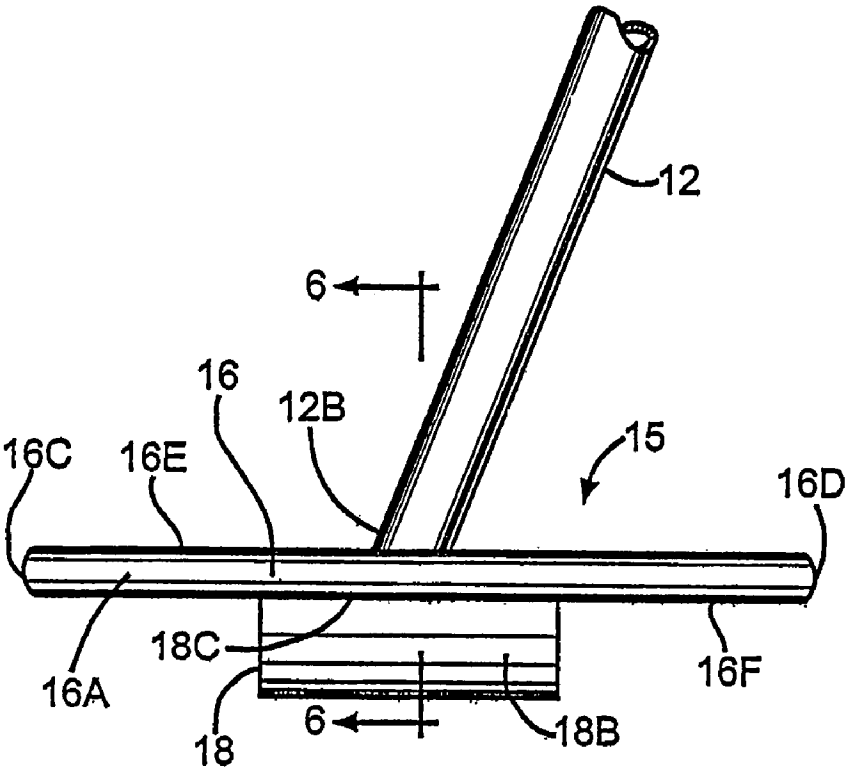
FIG. 2 illustrates affront view of the head 15 of the golf putter 10 of FIG. 1.

FIGS. 2-5 show the putter head 15 from various views. Putter head 15 comprises a blade 16 and a runner 18. FIG. 2 illustrates a front view of the golf putter head 15 of this embodiment. Elongate flat blade 16 is a thin horizontal rectangle with distance from heel edge 16D to toe edge 16C (length) approximately twice the distance from front edge 16A to back edge 16B (width). The dimension ratios can vary, however the length is greater than the width by U.S.G.A. rules. The front edge 16A of blade 16 is the striking face which contacts the golf ball 20. A top side 16E of the elongate flat blade 16 is attached to the distal end 12B of shaft 12. Upon the opposite face of the blade 16 is the bottom face 16F. A runner 18 with a semi-circular cross section (FIG. 6) is attached to the bottom side of the blade 16, with the front end 18C and back end 18D of the runner 18 directed lengthwise along the blade 16 parallel to front edge 16A. The outer surface 18B of runner 18 keeps the blade 16 the proper distance from the putting surface, and allows for a smooth swinging movement during the stroke.

Figure 3:
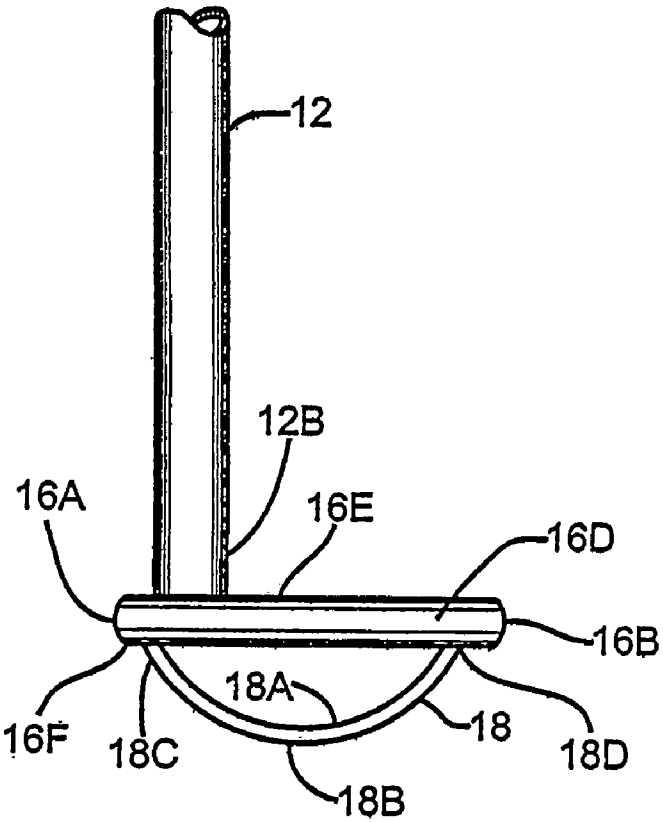
FIG. 3 illustrates a heel view of the golf putter head 15 of FIG. 2.
Figure 4:
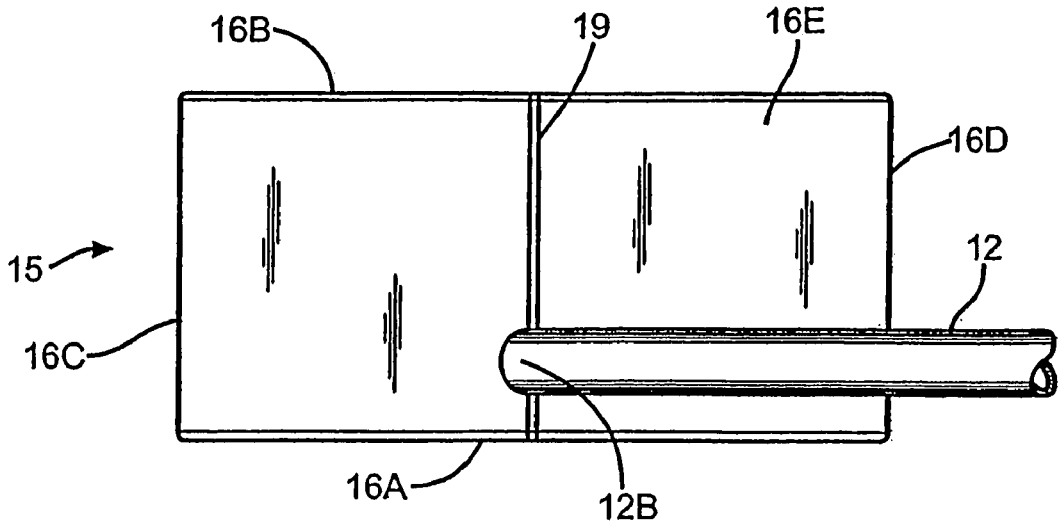
FIG. 4 illustrates a top view of the golf putter head 15 of FIG. 2.
Figure 5:
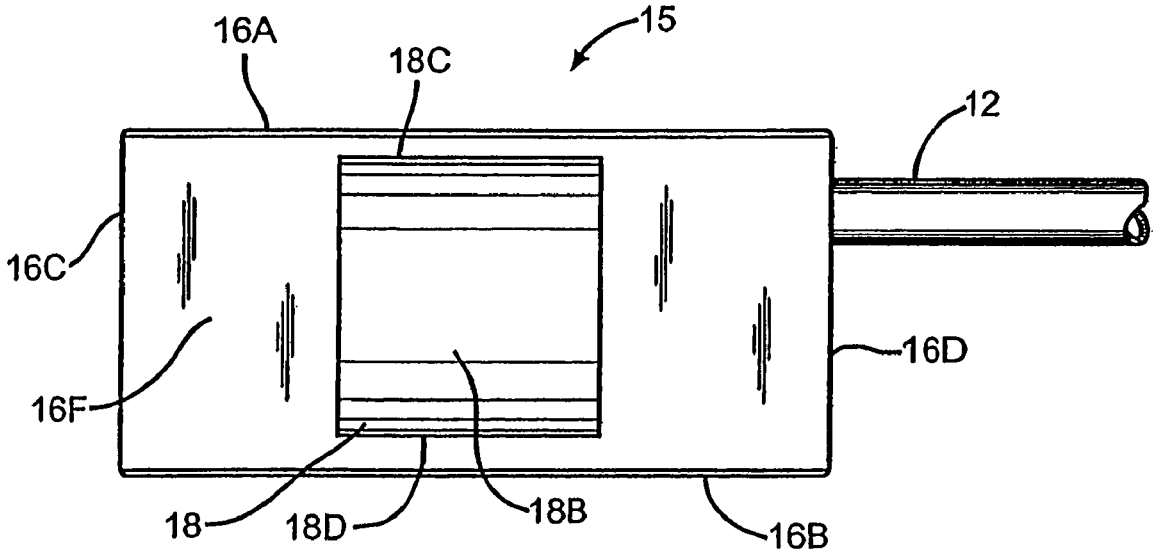
FIG. 5 illustrates a bottom view of the golf putter head 15 of FIG. 2.
Figure 6:
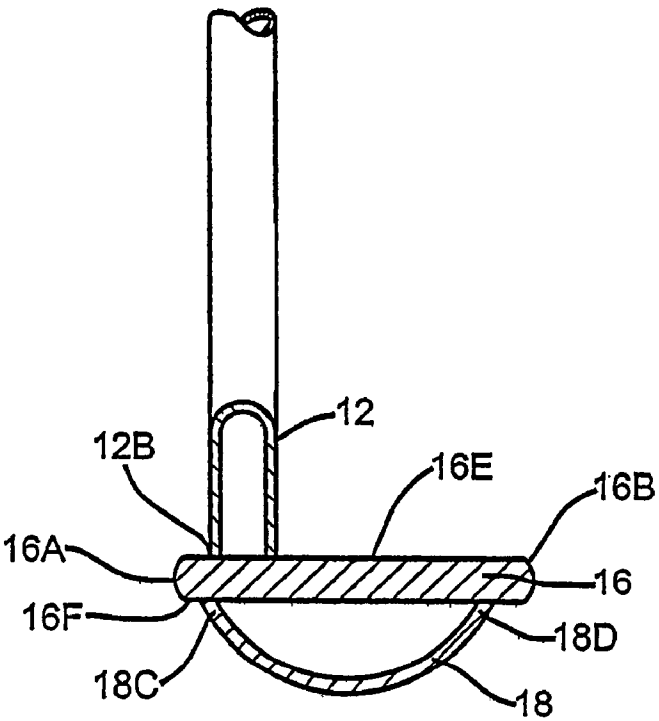
FIG. 6 illustrates a cross-section view of the golf putter head 15 of FIG. 2 taken along the line 6-6 of FIG. 2.

FIG. 3 illustrates a heel view of the golf putter head, and shows distal end 12B of shaft 12 attached to face 16E near front edge 16A. Heel edge 16D of blade 16 is shown in foreground. Outer surface 18B and inner surface 18A of hollow right cylindrical segment runner 18 are shown along the axis of runner 18. FIG. 4 illustrates a top view of the golf putter head with the distal end 12B of shaft 12 attached to the top side 16E of the blade 16, centrally located along the length along front edge 16A and near to front edge 16A along the width of blade 16. A sighting line 19 is marked along the top side 16E intersecting the front edge 16A and parallel to the toe edge 16C. FIG. 5 illustrates a bottom view of the golf putter head with the runner 18 attached to the bottom side of the elongate flat blade 16. FIG. 6 is a cross-section of the distal end of shaft 12 and head 15 along the plane indicated by 6-6 in FIG. 2. The hollow shaft 12 appears oval because of the angle made between the projection of the club shaft 12 upon the vertical plane. The bottom side 16F of plate 16 is shown attached to the front end 18C and back end 18D of runner 18. Front end 18C and back end 18D are attached forming lines parallel to front edge 16A.

Figure 9:
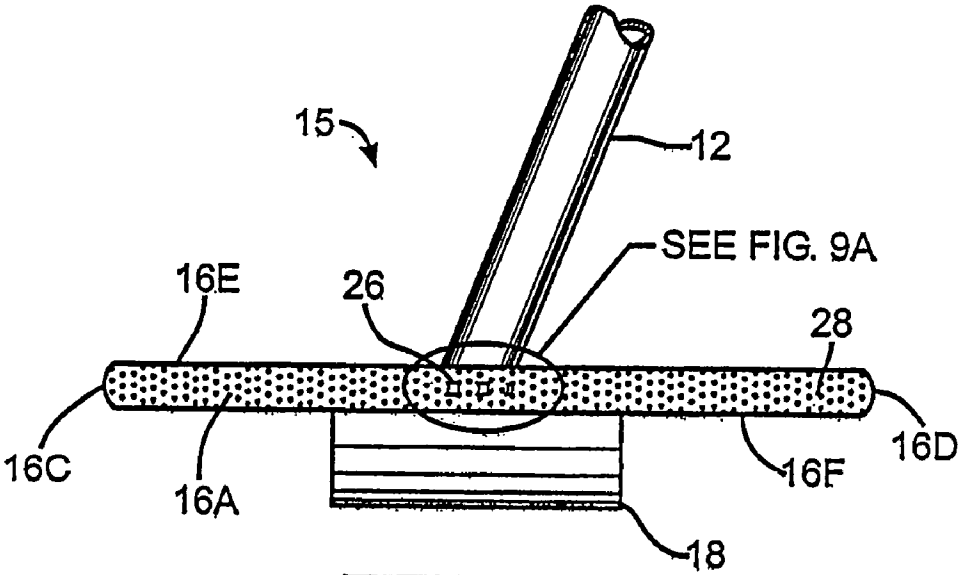
FIG. 9 illustrates a front view of a golf putter 10 of FIG. 2 showing the contact area 26 resulting from contact with the golf ball 20 of FIG. 8.
Figure 9A:
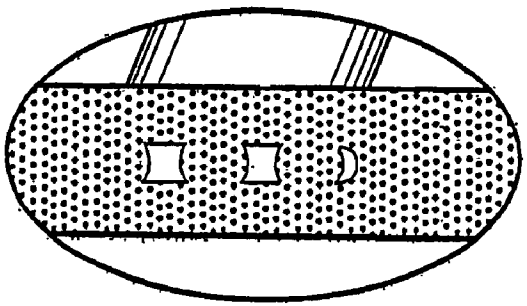
FIG. 9A illustrates a closer view of the designated region in FIG. 9.
Figure 8:
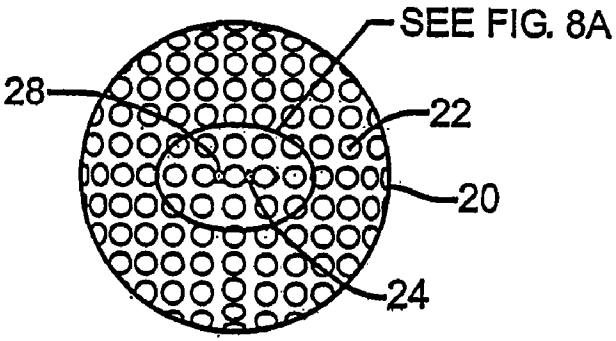
FIG. 8 illustrates a golf ball 20 showing the contact area 24 resulting from contact with a putter head 15 according to the present invention.
Figure 8A:
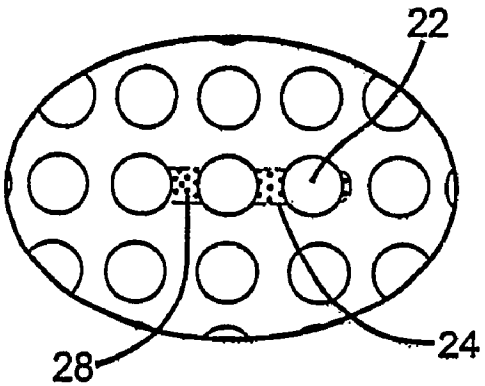
FIG. 8A illustrates a closer view of the designated region in FIG. 8.

The contact area 24 on the ball 20 and contact area 26 on the blade are small. FIG. 8A illustrates the contact area 24 upon the golf ball 20 made by striking the ball 20 with the elongate flat blade 16 covered with a powder 28. The contact area 24 is estimated by the powder 28 transferred from front edge 16A of blade 16 onto the golf ball 20 after the ball 20 has been struck with a powder coated front edge 16A of blade 16 as shown in FIG. 9. FIG. 9A illustrates the corresponding contact area 26 upon the elongate flat blade 16 after contacting the golf ball 20 of FIG. 8. The contact area 26 can be seen where the powder 28 has been removed from the front edge 16A of blade 16. The front edge 16A of the blade 16 was sprayed with a fine powder 28. The powder 28 adhered to the front edge 16A of the steel blade 16, but was easily removed by contact. A surface of a golf ball 20 coming into contact with the powder 28 was coated with the powder 28 at the contact area 24 with the front edge 16A of blade 16. The powder 28 coated putter head 15 was then used upon a golf green to strike a golf ball 20. The golf ball 20 was then examined to see the contact area 24 left upon the ball 20. This contact area 24 represented the area of the ball 20 which strikes the front blade 16A of the blade 16.

The contact area 24 was compared to the contact area (not shown) created by striking a ball with a traditional putter. The contact area 24 on the ball 20 from the front edge 16A of the elongate flat blade 16 had notable differences to the contact areas of a traditional putter. The contact area 24 on the golf ball 20 and contact area 26 on the blade 16 are both linear with a narrow width, and are also horizontal in orientation. Additionally, the contact area 24 on the ball 20 usually spanned the dimple 22 diameter on the golf ball 20 without entering the dimple 22 concavity, so that direction of roll is not influenced by the dimple 22 concavity.

Figure 9D:
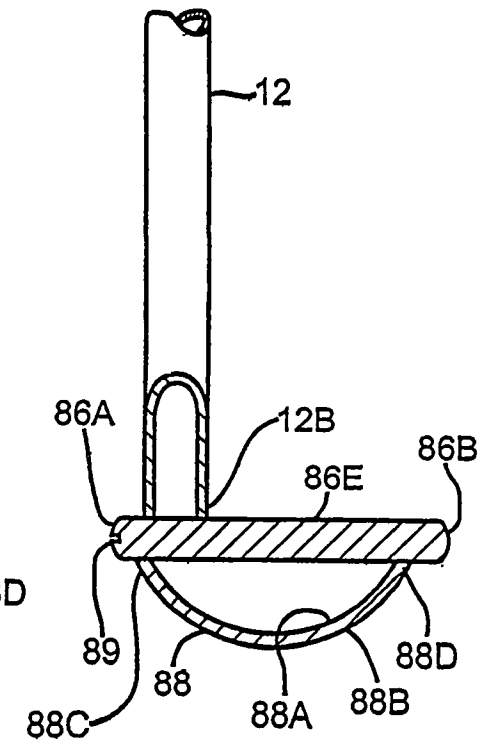
FIG. 9D illustrates a cross-section view of the golf putter head 85 of FIG. 9B taken along the line 9D-9D of FIG. 9B.
Figure 9C:
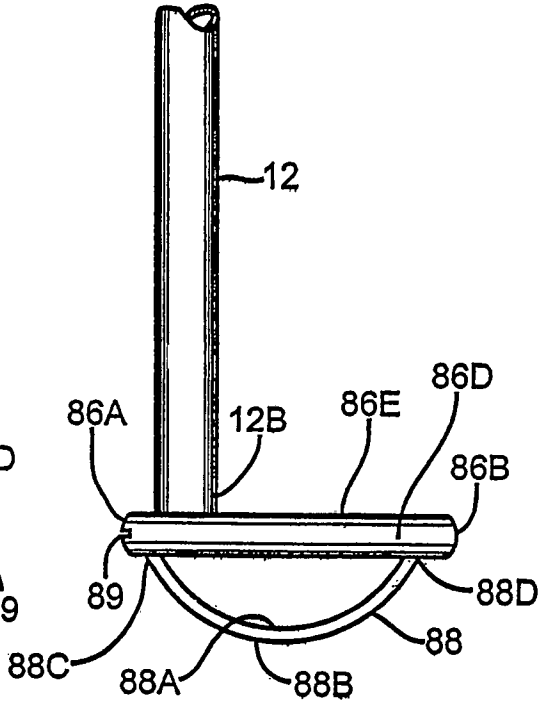
FIG. 9C illustrates a heel view of the golf putter head 85 of FIG. 9B.
Figure 9B:
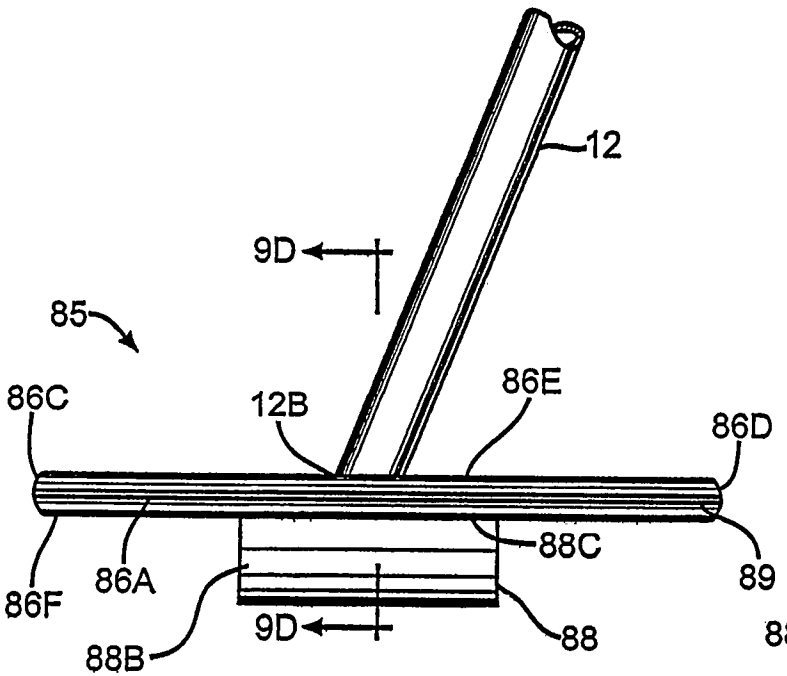
FIG. 9B illustrates a front view of the head 85 of an embodiment of an elongate flat blade golf putter 10 according to the present invention with a grooved blade 86.

FIGS. 9B, 9C, and 9D is a further embodiment of the putter head 85 of the present invention further comprising a groove 89 in the front edge 16A of blade 16. FIG. 9B shows the putter head 85 from a front view, showing the groove 89 in the front edge 86A of blade 86. Groove 89 runs horizontally across the center line of front edge 86A of the blade 86. Groove 89 is approximately 0.06 inches (1.5 mm) wide and approximately 0.04 inches (1.0 mm) deep and extends from wheel edge 86D to toe edge 86C. FIG. 9D illustrates a cross-section along the line 9D-9D of FIG. 9B showing the groove 89 with these dimensions. In further embodiments, the front edge 86A is flat and not convex.

The head 85 includes an elongate flat blade 86 and a runner 88. The elongate flat blade 86 includes a first linear edge as a front edge 86A, and a second linear edge as a back edge 86B, a toe edge 86C, a heel edge 86D, a top side 86E, and a bottom side 86F. The top side 86E and bottom side 86F are parallel sides of the blade. A runner 88 is attached to the bottom side 86F of the blade 86. The runner has an inner surface 88A, an outer surface 88B, a front end 88C, and a back end 88D. The front edge 86A of the blade 86 is the striking face for contacting the golf ball 20 between the ends defined by toe edge 86C and heel edge 86D, and the parallel sides of the top side 86E and bottom side 86F. The distal end 12B of shaft 12 is attached to the top side 86E of blade 86 such that the projection of the shaft 12 onto the vertical plane through the front edge 86A of the blade 86 is 10° or more. In further embodiments, the shaft 12 is attached to the blade 86 such that the projection of the shaft 12 upon a vertical plane through the toe edge 86C of the blade 86 is 20° or less. The elongate flat blade 86 is attached to the distal end 12B of the shaft 12 near front edge 86A at the center of the length of front edge 86A between toe edge 86C and heel edge 86D. The distal end 12B of shaft 12 is attached to the blade 86 at or near the area of anticipated contact of the blade 86 to the ball. In other embodiments, the shaft 12 is attached to the top side 86E of the blade 86 through a single plain neck or socket. The length along the neck or socket axis in these embodiments, following any bends, is approximately 5.0 inches (127 mm) or less. The overall length of the putter 10 from proximal end 12A of the shaft 12 to the outer surface 88B of runner 88 is at least approximately 18 inches (457 mm). Elongate flat blade 86 is a thin horizontal rectangle with distance from heel edge 86D to toe edge 86C (length) approximately twice the distance from front edge 86A to back edge 86B (width). The dimension ratios can vary, however the length is greater than the width by U.S.G.A. rules. The front edge 86A of blade 86 is the striking face which contacts the golf ball 20. A top side 86E of the elongate flat blade 86 is attached to the distal end 12B of shaft 12. Upon the opposite face of the blade 86 is the bottom face 86F. A runner 88 with a semi-circular cross section (FIG. 9D) is attached to the bottom side of the blade 86, with the front end 88C and back end 88D of the runner 88 directed lengthwise along the blade 86 parallel to front edge 86A. The outer surface 88B of runner 88 keeps the blade 86 the proper distance from the putting surface, and allows for a smooth swinging movement during the stroke. FIG. 9C illustrates a heel view of the golf putter head, and shows distal end 12B of shaft 12 attached to face 86E near front edge 86A. Heel edge 86D of blade 86 is shown in foreground. Outer surface 88B and inner surface 88A of hollow right cylindrical segment runner 88 are shown along the axis of runner 88.

Figure 10:
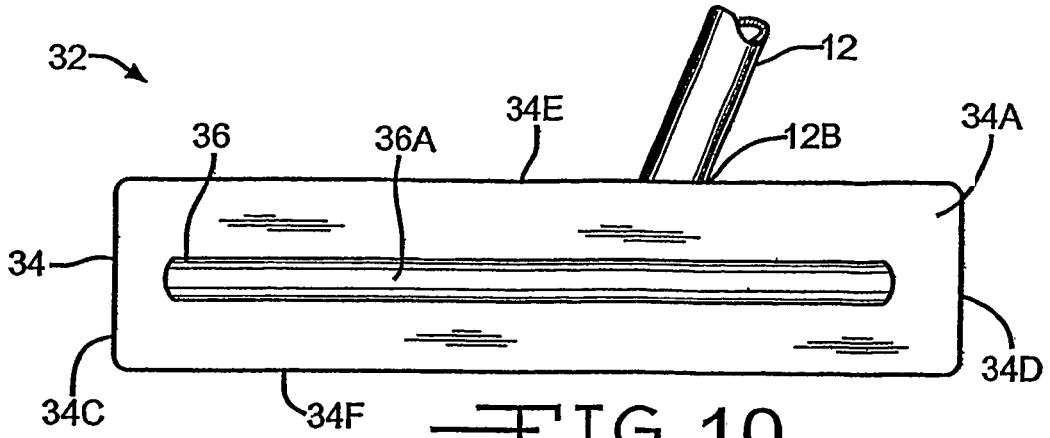
FIG. 10 illustrates a front view of another embodiment of a golf putter head 32 according to the present invention.
Figure 11:
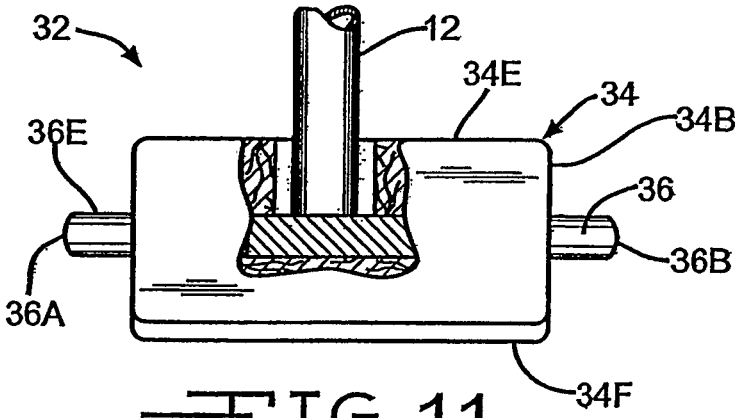
FIG. 11 illustrates a heel view of the golf putter head 32 of FIG. 10.
Figure 12:
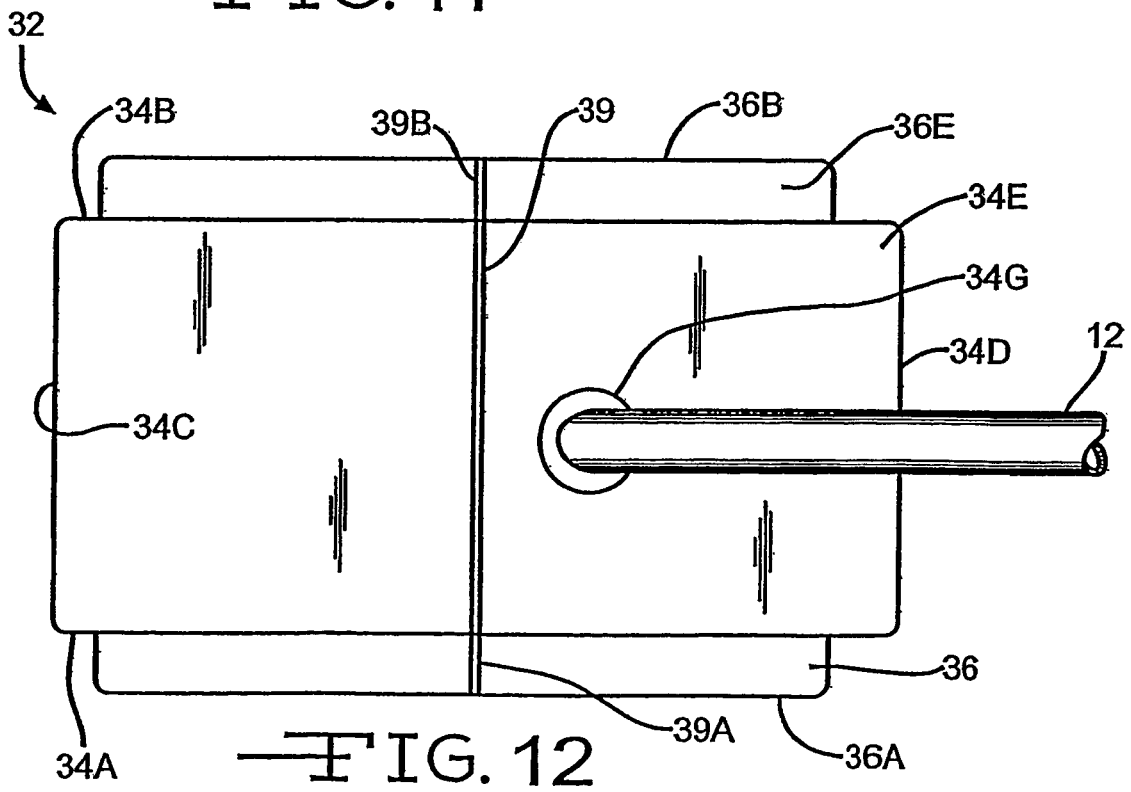
FIG. 12 illustrates a top view of the golf putter head 32 of FIG. 10.
Figure 14:
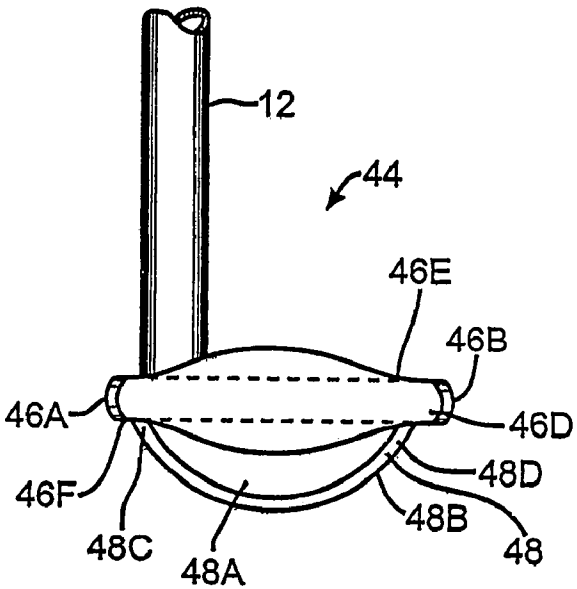
FIG. 14 illustrates a heel view of the golf putter head 44 of FIG. 13.
Figure 13:
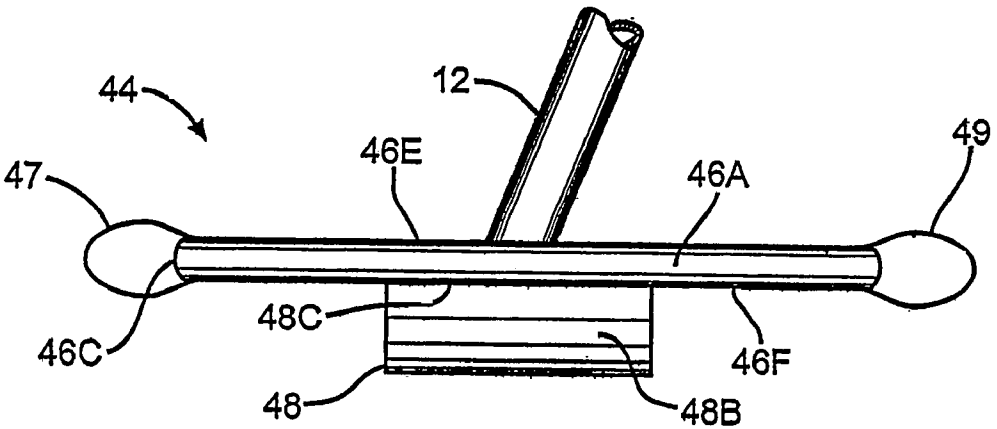
FIG. 13 illustrates a front view of a further embodiment of a golf putter head 44 according to the present invention.
Figure 15:
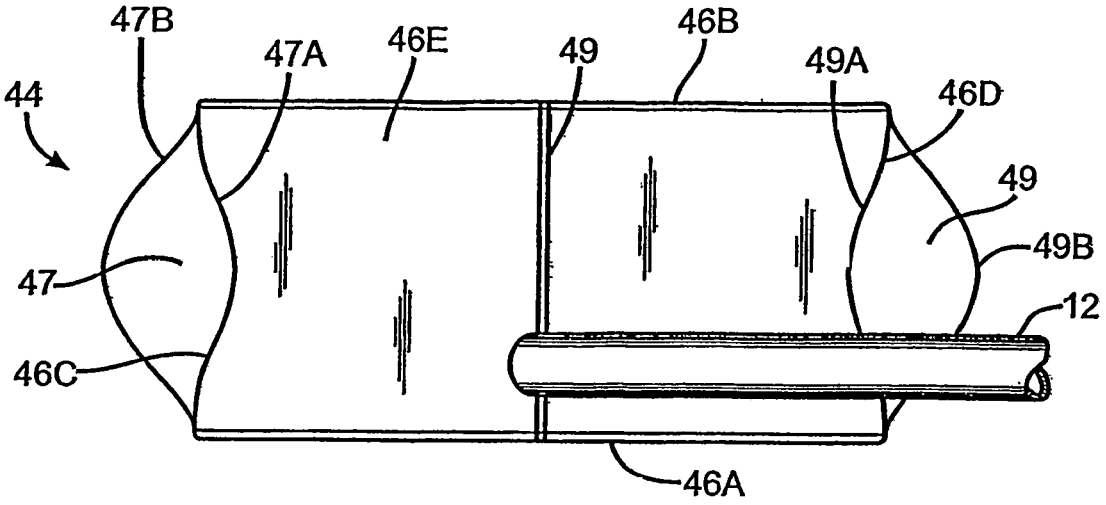
FIG. 15 illustrates a top view of a golf putter head 44 of FIG. 13.
Figure 16:
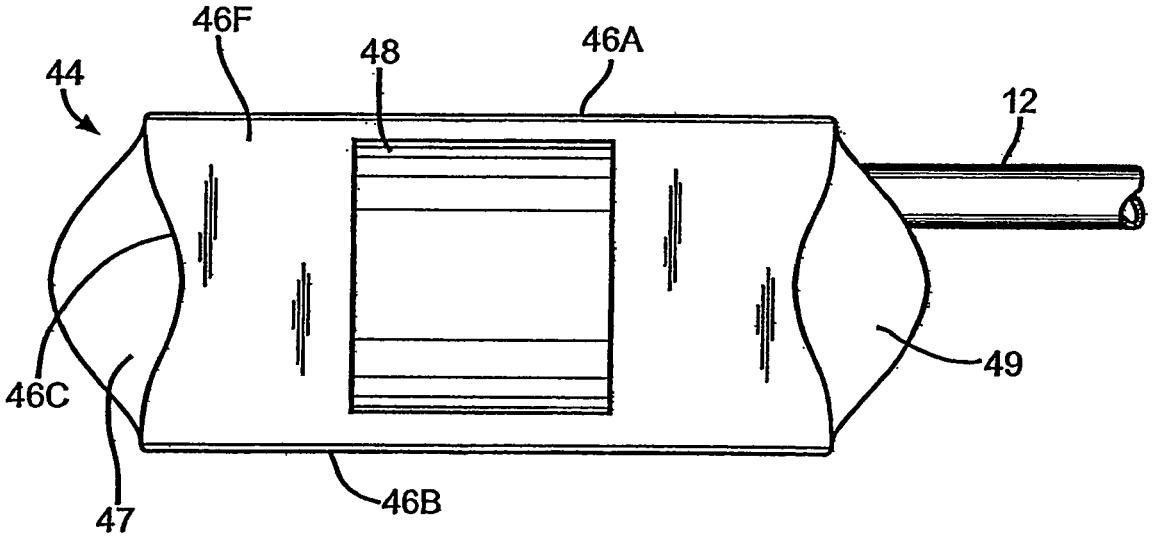
FIG. 16 illustrates a bottom view of a golf putter head 44 of FIG. 13.

FIGS. 10-12 show another embodiment of the golf putter head 32 from various views. Body 34 is a solid horizontal rectangular block with front side 36A, back side 36B, toe side 36C, heel side 36D, top side 36E, and bottom side 36F. An elongate flat blade 36, with a front side 36A, back side 36B, toe side 36C, heel side 36D, top side 36E, and bottom side 36F is encased within the body 34 of the putter head 32. The elongate flat blade extends from the body 34 at a first linear edge (front edge 36A), and a second linear edge (back edge 36B). The toe to heel length of side 34A is longer than the length of front edge 36A of blade 36. Front edge 36A and a portion of top side 36E of elongate flat blade 36 extend forward from the body 34 from the front side 34A. Likewise, back edge 36B and a short back portion of elongate flat blade 36 extends from the body 34 from back face 34B. The distal end 12B of shaft 12 penetrates the top surface 34E of body 34 through hole 34G, and attaches to the top side 36E of blade 36. FIG. 11 illustrates a heel view of the golf putter head 32 of the golf putter head of FIG. 10, showing a cut away to illustrate the shaft 12 attachment to the blade 16. Distal end 12B of shaft 12 penetrates the top side 34E of body 34. The front edge 36A and back edge 36B of blade 36 extends from sides 34A and 34B of body 34. FIG. 12 illustrates a top view of the golf putter head 32 of FIG. 10, showing a sighting line 39 which is marked along the top side 34E of body 34 intersecting the center of front edge 34A and parallel to the toe edge 34C. The front sighting line 39A is an extension of the sighting line 39 projected onto blade 36 on the front portion of the top side 36E. Likewise the back sighting line 39B is an extension of the sighting line 39 projected onto blade 36 on the back portion of the top side 36E.

FIGS. 13-16 illustrate a further embodiment of the present invention, which includes weights which allow the club to be weighted for a particular golf swing. The head 44 includes an elongate flat blade 46 and a runner 48. The elongate flat blade 46 includes a first linear edge as a front edge 46A, and a second linear edge as a back edge 46B, a toe edge 46C, a heel edge 46D, a top side 46E, and a bottom side 46F. The top side 46E and bottom side 46F are parallel sides of the blade. A runner 48 is attached to the bottom side 46F of the blade 46. The runner has an inner surface 48A, an outer surface 48B, a front end 48C, and a back end 48D. The front edge 46A of the blade 46 is the striking face for contacting the golf ball 20 between the ends defined by toe edge 46C and heel edge 46D, and the parallel sides of the top side 46E and bottom side 46F. The distal end 12B of shaft 12 is attached to the top side 46E of blade 46 such that the projection of the shaft 12 onto the vertical plane through the front edge 46A of the blade 46 is 10° or more. In further embodiments, the shaft 12 is attached to the blade 46 such that the projection of the shaft 12 upon a vertical plane through the toe edge 46C of the blade 46 is 20° or less. The elongate flat blade 46 is attached to the distal end 12B of the shaft 12 near front edge 46A at the center of the length of front edge 46A between toe edge 46C and heel edge 46D. The distal end 12B of shaft 12 is attached to the blade 46 at or near the area of anticipated contact of the blade 46 to the ball 20. In other embodiments, the shaft 12 is attached to the top side 46E of the blade 46 through a single plain neck or socket. The length along the neck or socket axis in these embodiments, following any bends, is approximately 5.0 inches (127 mm) or less. The dimensions may vary. The overall length of the putter 10 from proximal end 12A of the shaft 12 to the outer surface 48B of runner 48 is at least approximately 18 inches (457 mm).

The putter head 15 comprises a blade 46 and a runner 48. Elongate flat blade 46 is a thin horizontal rectangle with distance from heel edge 46D to toe edge 46C (length) approximately twice the distance from front edge 46A to back edge 46B (width). The dimensions can vary, however the length is greater than the width by U.S.G.A. rules. The front edge 46A of blade 46 is the striking face which contacts the golf ball 20. A top side 46E of the elongate flat blade 46 is attached to the distal end 12B of shaft 12. Upon the opposite face of the blade 46 is the bottom face 46F. A runner 48 with a semi-circular cross section is attached to the bottom side 46F of the blade 46, with the front end 48C and back end 48D of the runner 48 directed lengthwise along the blade 46 parallel to front edge 46A. The runner 48 is attached to the bottom side 46F of the blade 46 by means of a weld, screw, or any other means known in the art. The outer surface 48B of runner 48 keeps the blade 46 the proper distance from the putting surface, and allows for a smooth swinging movement during the stroke. In other embodiments, the runner 48 is a hemisphere. In further embodiments, the runner 48 is thin to avoid scuffing upon the ground. The runner can be of any shape which keeps blade 46 at a height above the ground.

The toe edge 46C and heel edge 46D are curved inward at the center of the edge and accept the attachment of toe weight 47 and heel weight 49, respectively. Toe weight 47 and heel weight 49 can be independently varied in mass to fit the swing of the individual golfer. This adjusts the center of gravity up and down. This is important when fitting the club to the golfer's individual swing to derive the best possible putt. Toe weight 47 and heel weight 49 can be made of any dense material to balance the club swing. Toe weight 47, curves outward at the attachment edge 47A to closely fit to the toe edge 46C of blade 46. The outward edge 47B of toe weight 47 curves smoothly outward from toe edge 46C. The top surface 47C of toe weight 47 bulges upward convexly, while the bottom surface 47D bulges downward convexly. This gives a smooth aesthetic appearance, while allowing for a larger volume and therefore increased mass for the toe weight 47. Likewise, in a symmetrical manner, heel weight 49 curves outward at the attachment edge 49A to closely fit to the heel edge 46D of blade 46. The outward edge 49B of heel weight 49 curves smoothly outward from heel edge 46D. The top surface 49C of heel weight 49 bulges upward convexly, while the bottom surface 49D bulges downward convexly. This gives a smooth aesthetic appearance, while allowing for a larger volume and therefore increased mass for the heel weight 49. The toe weight 47 and heel weight 49 are thereby symmetrical with respect to the center of mass of the blade 16. Addition of toe weight 47 and heel weight 49 of different masses allows a user to adjust the center of mass of the complete putter head 44. Therefore, the center of mass of the putter head 44 can be adjusted to fall behind any point for contacting golf ball 20 along front edge 46A which is preferred by the user. In further embodiments, the runner 48 weight can be varied to further shift the center of mass. This can be accomplished by modifying the shape of the runner 48, or the material of which the runner 48 is constructed.

Figure 17:
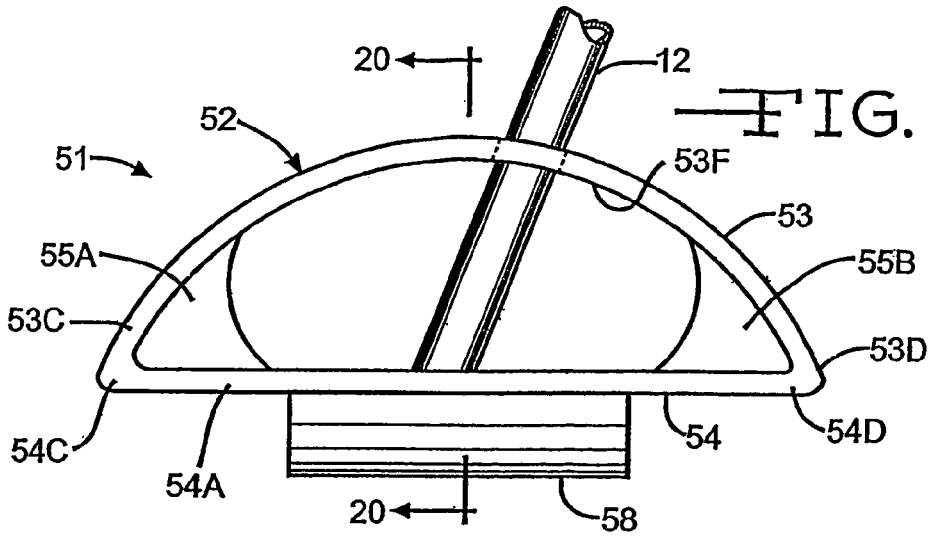
FIG. 17 illustrates a front view of still a further embodiment of a golf putter head 51 according to the present invention with a unitary head.

FIGS. 17-20 show still a further embodiment of the present invention from various views. FIG. 17 illustrates a front view of the golf putter head 51 of this embodiment. The head 51 of the golf putter 10 has a unitary body 52 section attached to a runner 58. The unitary body 52 section includes an arching top 53 contiguous with an elongate flat blade 54 bottom. The arching top 53 is a cylindrical section which arches upward with an axis (not shown) running front to back along club head 51, having a toe edge 53C, heel edge 53D, top side 53E, and bottom side 53F. The elongate flat blade 54 having a first linear edge (front edge 54A), a second linear edge (back edge 54B), toe edge 54C, heel edge 54D, top side 54E, and bottom side 54F. The toe edge 53C and heel edge 53D of the arching top 53 are contiguous with the toe edge 54C and heel edge 54D, respectively, of blade 54. Toe bracket 55A attaches the bottom side 53F of the arching top 53 of the body 52 to the top side 54E of the blade 54. Heel bracket 55B attaches the bottom side 53F of arching top 53 of body 52 to the top side 54E of blade 54. The distal end 12B of shaft 12 penetrates arching top 53 and is attached to the top side 54E of the elongate flat blade 54 of unitary body 52.

Figure 19:
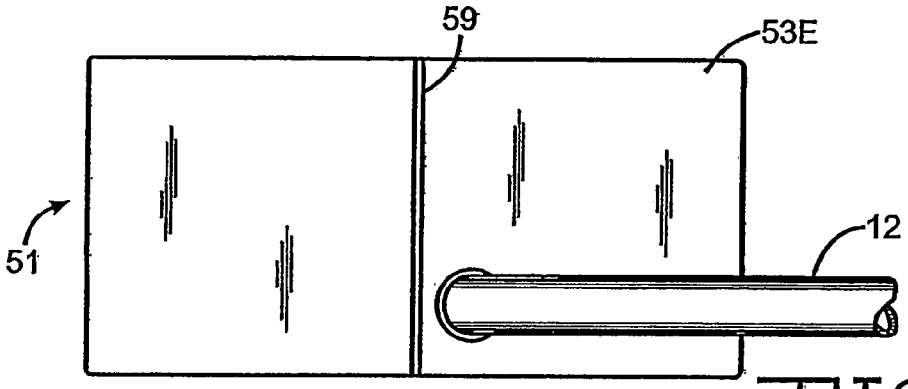
FIG. 19 illustrates a top view of the golf putter head 51 of FIG. 17.
Figure 18:
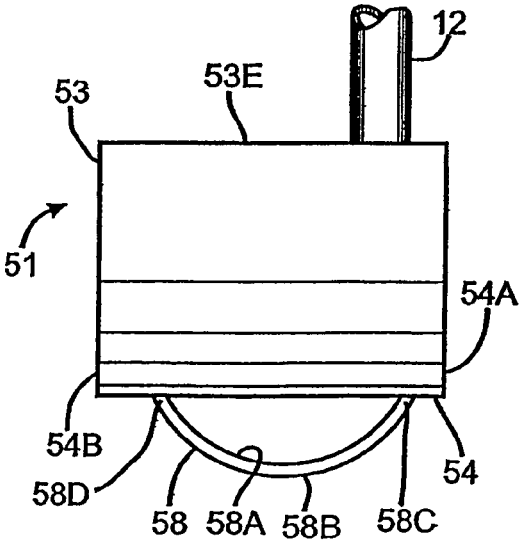
FIG. 18 illustrates a toe view of the golf putter head 51 of FIG. 17.
Figure 20:
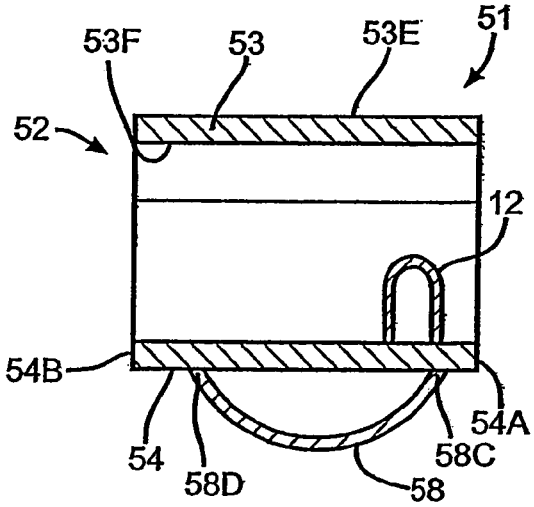
FIG. 20 illustrates a cross-section view of the golf putter head 51 of FIG. 17 taken along the line 20-20 of FIG. 17.

The shaft 12 penetrates, but does not contact, arching top 53 and is attached to the top side 54E of the blade 54 such that the projection of the shaft onto the vertical plane through the front edge 54A of the blade 54 is approximately 10° or more from the vertical. The shaft 12 penetrates the arching top 53 and is attached to the blade 54 such that the projection of the shaft 12 upon the vertical plane through the toe edge 54C of the blade 54 is 20° or less from vertical. FIG. 19 illustrates a top view of the golf putter head. A sighting line 59 is marked along the apex of the top side 53E of the arching top 53 of body 52 intersecting the front edge 53A and parallel to the toe edge 54C of blade 54. FIG. 20 illustrates a cross-section along the line 20-20 of FIG. 17 showing the distal end 12B of shaft 12 attached to the elongate flat blade 53A section of unitary body 52. The runner 58 is semi-circular in cross section (FIG. 20) attached to the bottom side of the elongate flat blade 54 portion of body 52.

Figure 21:
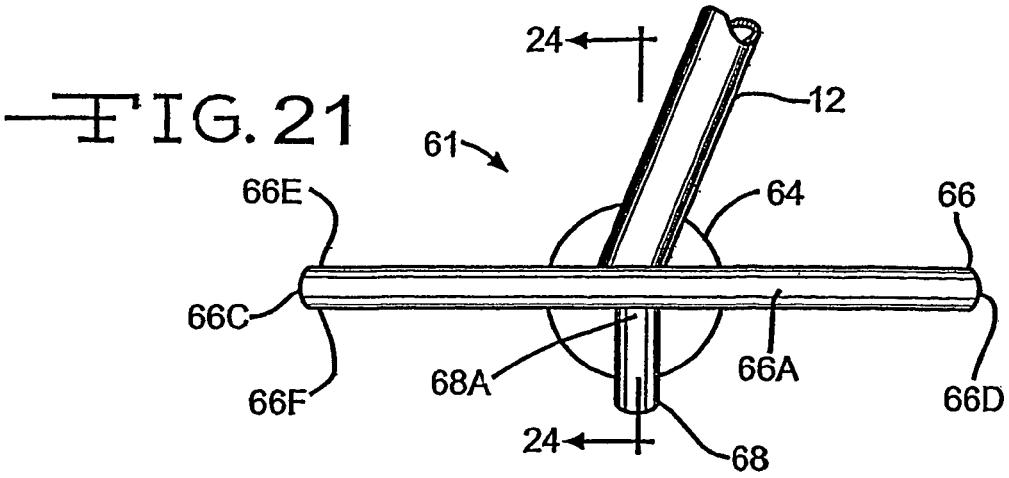
FIG. 21 illustrates a front view of still a further embodiment of a golf putter head 61 according to the present invention.
Figure 22:
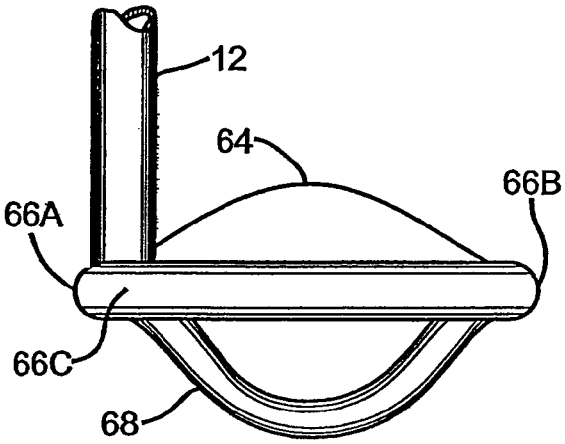
FIG. 22 illustrates a heel view of the golf putter head 61 of FIG. 21.
Figure 24:
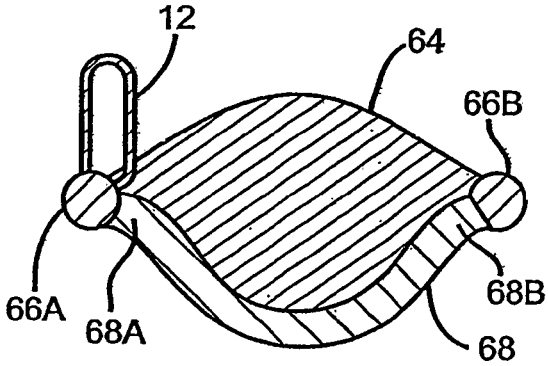
FIG. 24 illustrates a cross-section view of the golf putter head 61 of FIG. 21 taken along the line 24-24 of FIG. 21.
Figure 23:
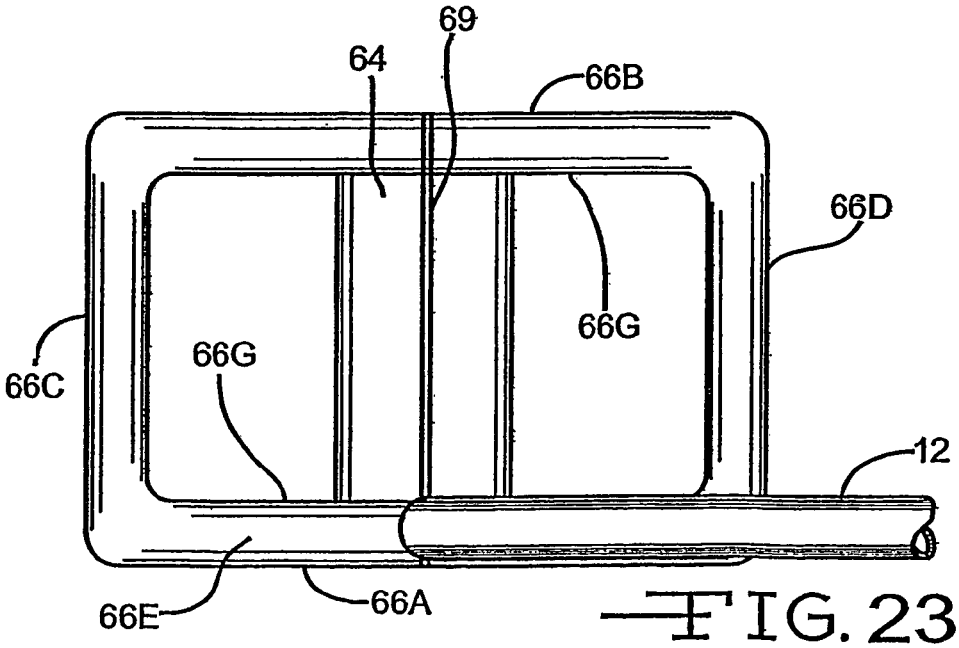
FIG. 23 illustrates a top view of the golf putter head 61 of FIG. 21.

FIGS. 21-23 show still a further embodiment of the present invention from various views. The distal end 12B of shaft 12 is attached to the elongate flat blade 66. The elongate flat blade has a first linear edge (front edge) 66A, and a second linear edge (back edge) 66B, a toe edge 66C, a heel edge 66D, a top side 66E, and a bottom side 66F. In this embodiment, the elongate flat blade 66 is formed from a round rod shaped into a continuous rectangular loop. A rectangular hollow region is thus defined by the inner sides 66G of the blade 66. The distance from heel edge 66D to toe edge 66C (length) is approximately twice the distance from the front edge 66A to back edge 66B (width). The dimensions vary, however the length is greater than the width by U.S.G.A. rule. The front edge 66A of blade 66 is the striking face which contacts the golf ball 20. A top side 66E of the front edge 66A of the elongate flat blade 66 is attached to the distal end 12B of shaft 12. Upon the opposite side of the blade 66 is the bottom side 66F. A body 64 which is roughly ellipsoid in shape attaches along the center of the length of the golf club head 61, attaching to the inner side 66G of the blade 66. A convex runner 68 is connected underneath the body 64 and attaches at front end 68A to the inner side 66G of front edge 66A of the blade 66. Likewise, the runner 68 attaches at the back end 68B to the inner surface 66G of back edge 66B of blade 66. FIG. 22 illustrates a heel view of the golf putter head of FIG. 21; showing the runner 86 under the body 64. FIG. 21 illustrates that the runner 68 is narrow in this embodiment. FIG. 24 illustrates a cross-section along the plane indicated by 24-24 of FIG. 21. While the rod which forms the blade 66 is shown as solid, it can be hollow in further embodiments.

Figure 25C:
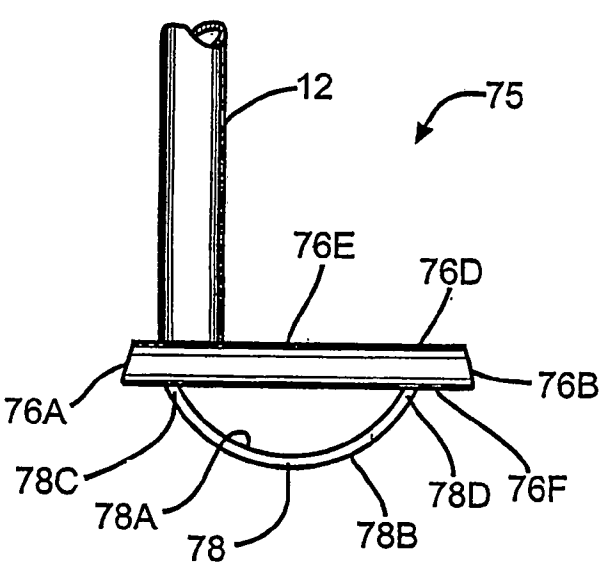
FIG. 25C illustrates a heel view of still a further embodiment of a golf putter head 75 according to the present invention with a sharp blade edge 76A which is sharp at the bottom.
Figure 25B:
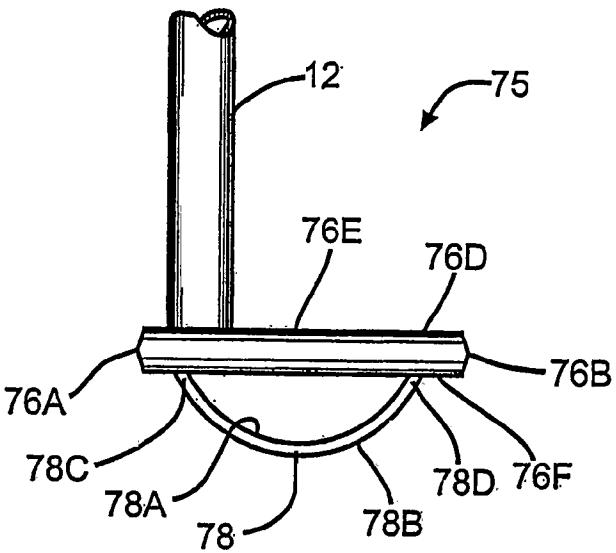
FIG. 25B illustrates a heel view of still a further embodiment of a golf putter head 75 according to the present invention with a sharp blade edge 76A which is sharp in the center.
Figure 25A:
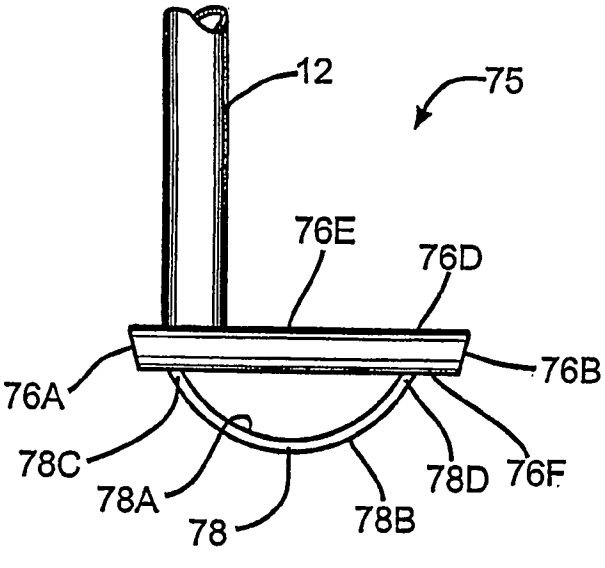
FIG. 25A illustrates a heel view of still a further embodiment of a golf putter head 75 according to the present invention with a sharp blade edge 76A which is sharp at the top.

FIGS. 25A-C show still further embodiments of the present invention from a heel view, which have a sharp front edge 76A. The head 75 includes an elongate flat blade 76 and a runner 78. The elongate flat blade 76 includes a first linear edge as a front edge 76A, and a second linear edge as a back edge 76B, a toe edge 76C, a heel edge 76D, a top side 76E, and a bottom side 76F. The elongate flat blade 76 comes to a sharp edge in the middle of the front edge 76A of the blade 76 in one embodiment (FIG. 25B). Further embodiments include a blade which has a sharp edge at the bottom (FIG. 25C). In a further embodiment, the front edge 76A has a sharp edge at the top (FIG. 25A). The front edge 76A is preferably about 15° or less from vertical in each embodiment by rule. The top side 76E and bottom side 76F are parallel sides of the blade 76. A runner 78 is attached to the bottom side 76F of the blade 76. The runner 78 has an inner surface 78A, an outer surface 78B, a front end 78C, and a back end 78D. The front edge 76A of the blade 76 is the striking face for contacting the golf ball 20 between the ends defined by toe edge 76C and heel edge 76D, and the parallel sides of the top side 76E and bottom side 76F. The distal end 12B of shaft 12 is attached to the top side 76E of blade 76 such that the projection of the shaft 12 onto the vertical plane through the front edge 76A of the blade 76 is 10° or more. In further embodiments, the shaft 12 is attached to the blade 76 such that the projection of the shaft 12 upon a vertical plane through the toe edge 76C of the blade 76 is 20° or less. The elongate flat blade 76 is attached to the distal end 12B of the shaft 12 near front edge 76A at the center of the length of front edge 76A between toe edge 76C and heel edge 76D. The distal end 12B of shaft 12 is attached to the blade 76 at or near the area of anticipated contact of the blade 76 to the ball. In other embodiments, the shaft 12 is attached to the top side 76E of the blade 76 through a single plain neck or socket. The length along the neck or socket axis in these embodiments, following any bends, is approximately 5.0 inches (127 mm) or less. The overall length of the putter 10 from proximal end 12A of the shaft 12 to the outer surface 78B of runner 78 is at least approximately 18 inches (457 mm).

Figure 34:
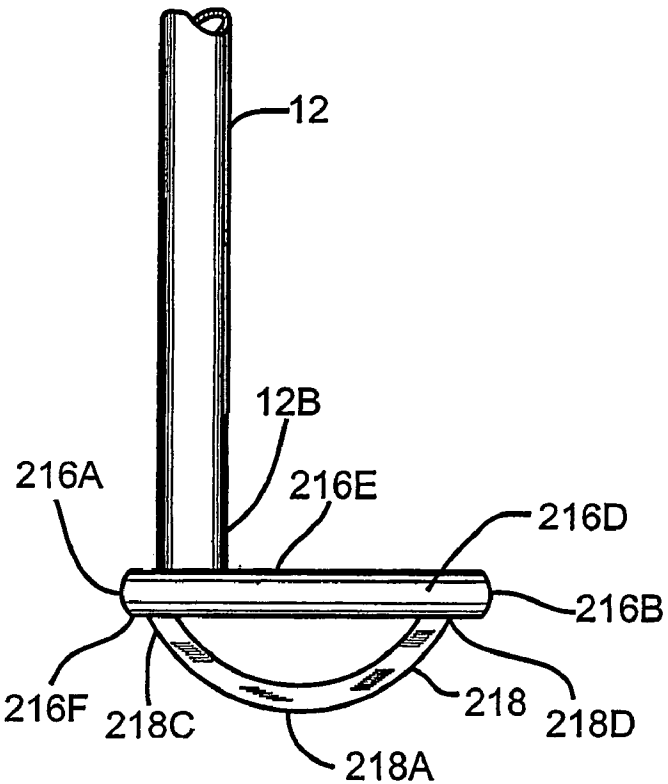
FIG. 34 is a heel view of a golf putter of FIG. 33 showing one of the sharp runners 218.
Figure 33:
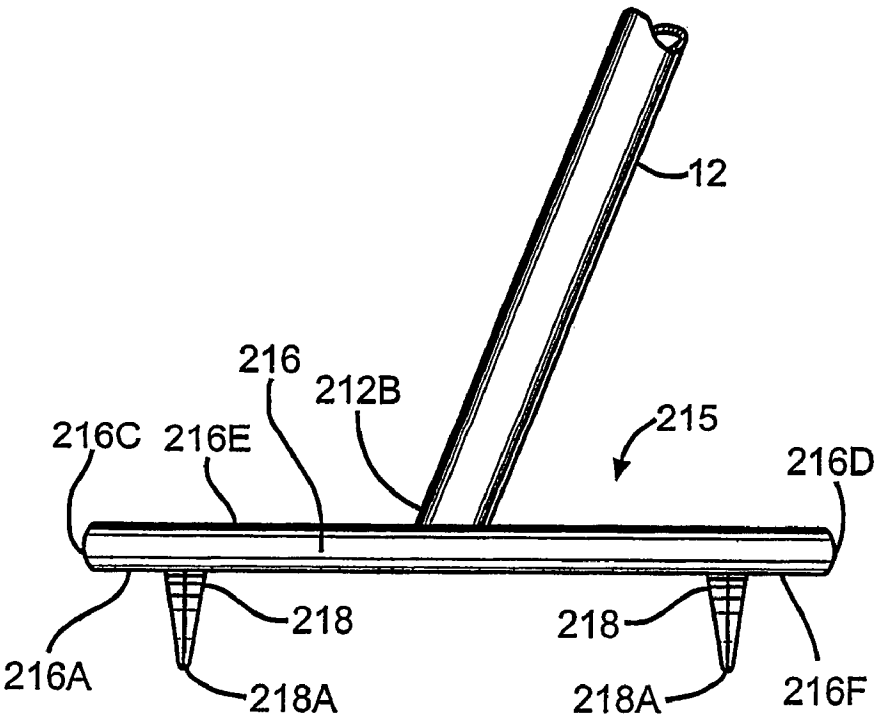
FIG. 33 is a front view of a golf putter head showing sharp runners 218 perpendicular to the face of the putter.

Elongate flat blade 76 is a thin horizontal rectangle with distance from heel edge 76D to toe edge 76C (length) approximately twice the distance from front edge 76A to back edge 76B (width). The dimensions can vary, however the length is greater than the width by U.S.G.A. rules. The front edge 76A of blade 76 is the striking face which contacts the golf ball 20. A top side 76E of the elongate flat blade 76 is attached to the distal end 12B of shaft 12. Upon the opposite face of the blade 76 is the bottom face 76F. A runner 78 with a semi-circular cross section is attached to the bottom side of the blade 76, with the front end 78C and back end 78D of the runner 78 directed lengthwise along the blade 76 parallel to front edge 76A. The outer surface 78B of runner 78 keeps the blade 76 the proper distance from the putting surface, and allows for a smooth swinging movement during the stroke. This curved surface keeps the blade 76 the proper distance from the putting surface, and allows for a smooth swinging movement during the stroke. The curvature also minimizes scuff as the club swings along the ground. Also, relatively thin blades in the direction of the put can be used as shown in FIGS. 33 and 34 hereinafter.

Figure 26:
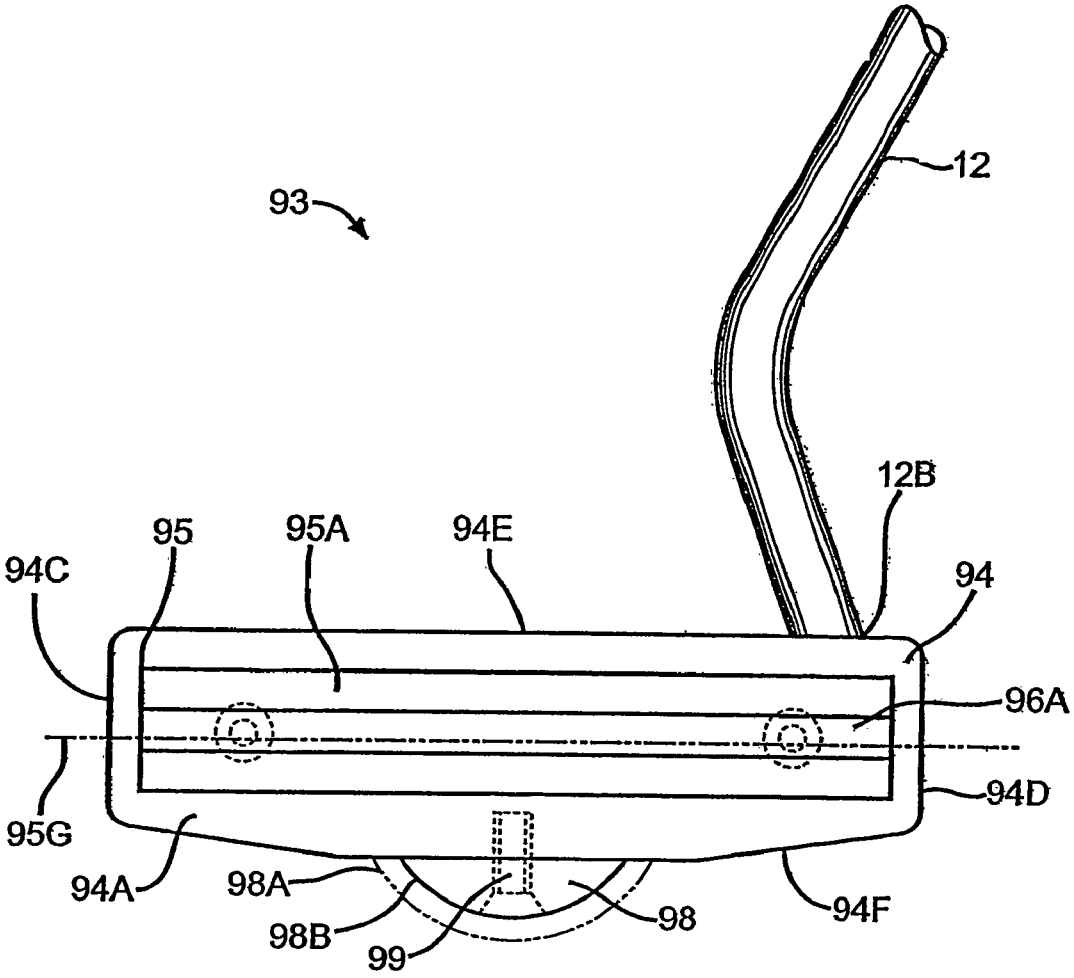
FIG. 26 illustrates an embodiment of a golf putter head 93 according to the present invention with an adjustable blade 96 and convexly rounded runner 98.
Figure 27:
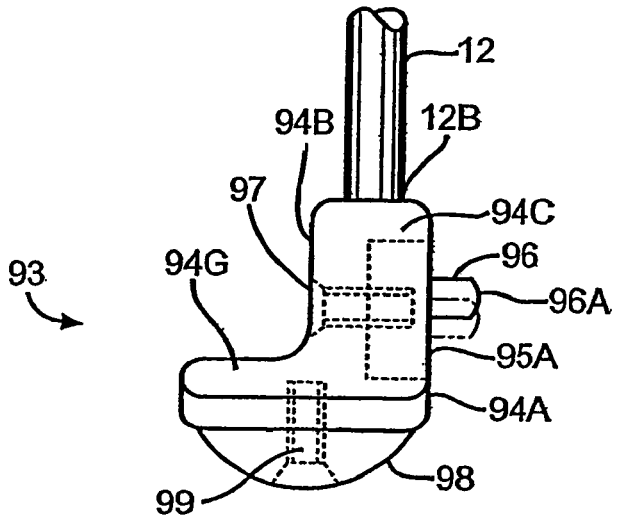
FIG. 27 illustrates a toe view of the golf putter head 93 of FIG. 26 with an adjustable blade 96 and convexly rounded runner 98.

FIG. 26 illustrates a front view of an embodiment of an elongate flat blade putter 93 of the present invention which is useful for fitting a golf putter to a person having a particular golf stroke. The golf putter 93 includes a shaft 12, a body 94, a face plate 95, and a convexly rounded runner 98. The body 94 is a solid block having an L-shape with a front side 94A, back side 94B, toe side 94C, heel side 94D, top side 94E, and a bottom side 94F forming an essentially rectangular section, and a flared lower portion 94G which extends outward from the rectangular section along the bottom side 94F of the body 94. The distal end 12B of the shaft 12 attaches to the top side 94E of body 94. The bottom side 94F of the body 94 has a truncated triangular shape such that the thickness of the body 94 at the toe side 94C and the heel side 94D is less than the thickness of a middle portion of the body 94 spaced between the toe and heel side 94D is less than the thickness of a middle portion of the body 94 spaced between the toe and heel sides 94C and 94D. The toe to heel length of the front side 94A is longer than the length of bottom side 94F along flared lower portion 94G of the body 94. The front side 94A of the body 94 has a rectangular hollow portion 94H.

The face plate 95 is mounted in the hollow portion 94H in the front side 94A of the body 94. The hollow portion 94H in the front side 94A of the body 94 has a shape similar to the shape of the face plate 95. In one (1) embodiment, the face plate 95 has a rectangular shape with a front side 95A, a back side 95B, a toe side 95C, a heel side 95D, a top side 95E, and a bottom side 95F. The hollow portion 94H has the same width and height as the back side 95B of the face plate 95, and is deep as the front to back width of toe side 95C, heel side 95B, top side 95E, and bottom side 95F of face plate 95, so that the face plate 95 can fit snugly and flush within the rectangular hollow portion 94H in the front side 94A of body 94.

Figure 28:
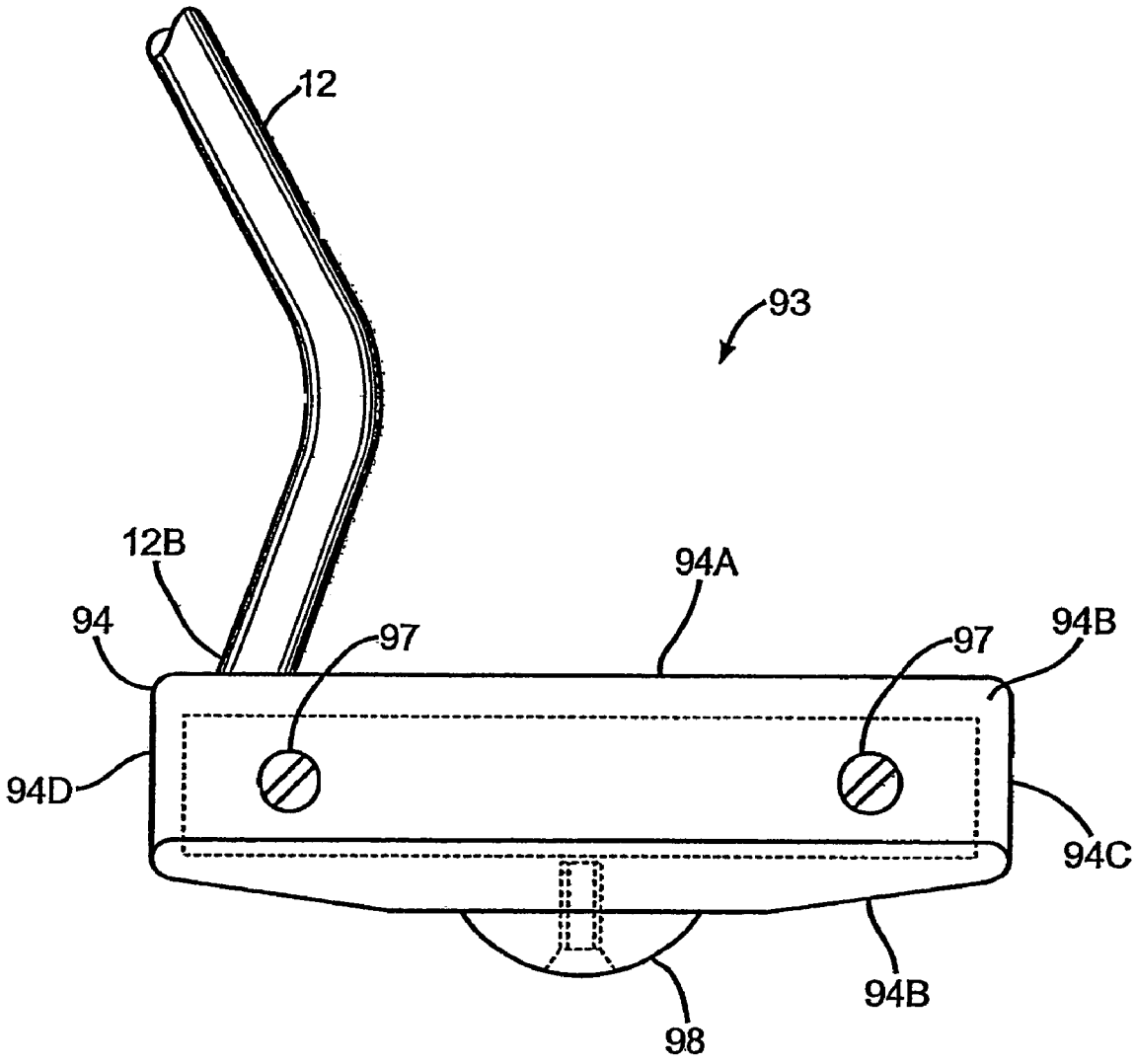
FIG. 28 illustrates a back view of the golf putter head 93 of FIG. 26 with an adjustable blade 96 and convexly rounded runner 98.

An elongate flat blade 96 is contiguous with the front side 95A of the face plate 95. The elongate flat blade 96 is mounted off center from the vertical centerline 95G of front side 95A of face plate 95. This allows for the face plate 95 to be inserted in the upside down position with the bottom side 95F adjacent to the top side 94E of the body 94, so that the elongate flat blade 96 can be shifted to a higher or lower vertical position. In one (1) embodiment, the face plate 95 is attached to the body 94 by a set of two (2) screws 97 which penetrate the body 94 from the back side 94B. FIG. 28 illustrates the back side 94B of putter body 94, showing the set of two (2) screws 97. However, it is understood that the face plate 95 can be attached to the body 94 by any means well known in the art. In another embodiment, the means for attaching the face plate 95 are Allen screws which penetrate the front side 95A of the face plate 95 into the body 94. When the face plate 95 is mounted within the hollow portion 94H in the front side 94A of the body 94, the blade 96 extends outward from the front side 94A of the body 94 in a direction opposite the back side 94B of the body 94. The elongate flat blade 96 extends outward horizontally from the front side 95A of face plate 95 so that the front edge 96A of the blade 96 is used to strike the golf ball 20.

The convexly rounded runner 98 has a solid semi-spherical shape and is attached by an attachment means to the bottom side 94F of the body 94 so that the flat side of the convexly rounded runner 98 is adjacent the bottom side 94F of the body 94. The convexly rounded runner 98 can be attached to the bottom side 94F of the body 94 by any means well known in the art. In one (1) embodiment, the convexly rounded runner 98 is attached with a screw 99 centrally penetrating the convexly rounded runner 98 to fasten the convexly rounded runner 98 into the bottom side 94F of the body 94. The convexly rounded runner 98 of a width, can thereby be interchanged with a runner of a different width. In further embodiments, an Allen wrench is used to switch the convexly rounded runner 98 from the bottom side 94F of body 94 with another runner of a different width. An assortment of runners with a range of radii can be attached, which allow the person being fitted to select the runner which has the proper radius for the person's individual golf stroke. In some embodiments of the runner attachment means could not be fastened or removed with fingers or fingernails, but would require a wrench or similar device for attachment or removal of a convexly rounded runner 98.

Figure 29:
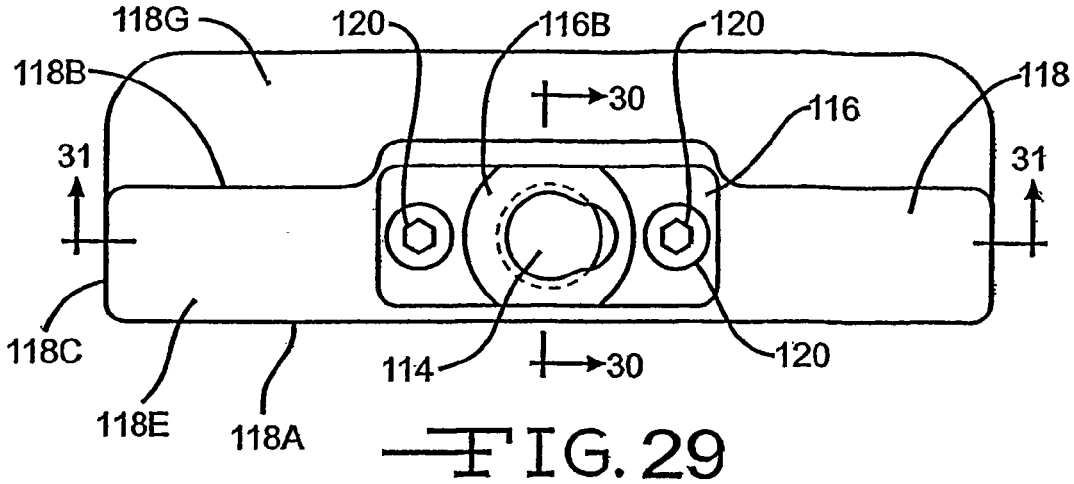
FIG. 29 illustrates a top view of an embodiment of a golf putter head 93 with an adjustable, pivoting shaft 112 according to the present invention.
Figure 30:
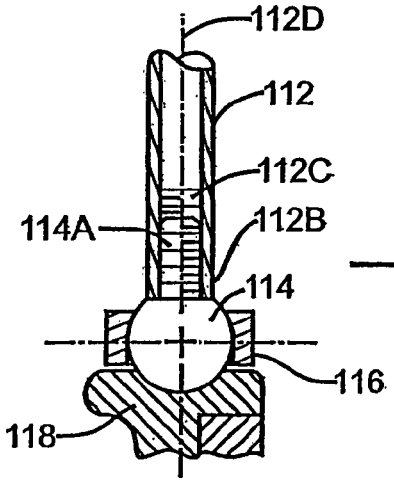
FIG. 30 illustrates a cross-section view of the golf putter head 93 of FIG. 29 taken along the line 30-30 of FIG. 29.
Figure 31:
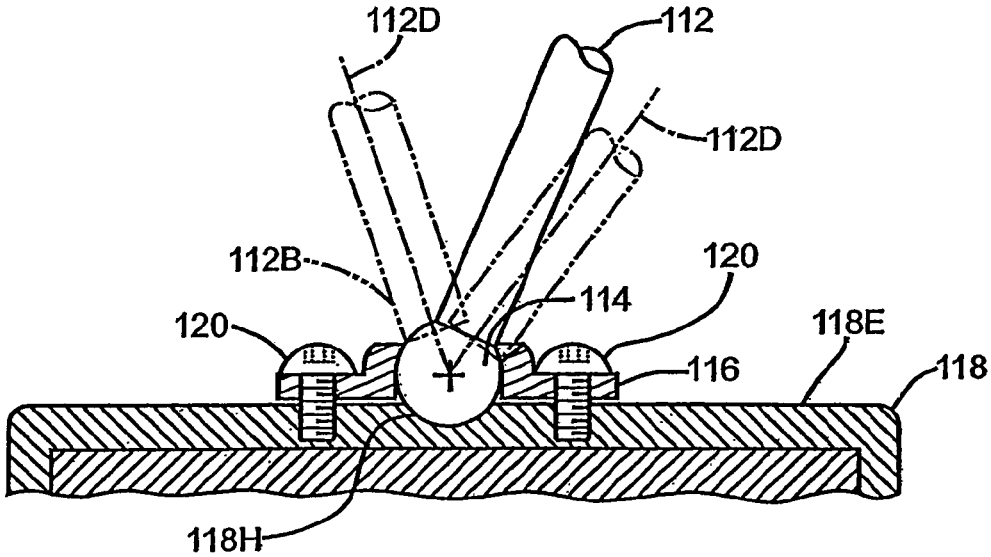
FIG. 31 illustrates a cross-section view of the golf putter head 93 of FIG. 29 taken along the line 31-31 of FIG. 29.

FIGS. 29-31 illustrate various views of one (1) embodiment of an attachment means for pivotably attaching an elongate flat blade putter head 93 useful for fitting a golf putter to a person having a particular golf stroke. The attachment means allows for pivoting the axis 112D of the shaft 112 with respect to the putter body 118 at a pivot angle which allows the body 118 to remain parallel to the ground with the particular golf stroke of a person. The body 118 has a front side 118A, toe side 118C, heel side 118D, top side 118E, and flared lower portion 118G. The body is a rectangular block towards the top side 118E, and flares backward at the flared lower portion 118G towards the bottom side of the putter head 118. The distal end 112B of shaft 112 has inside surface threading 112C along the shaft axis. A ball 114 with a threaded metal screw extension 114A is screwed into the inside threading 112C of distal end 112B of shaft 112 after first inserting the threaded metal screw extension 114A through the opening 116A in a raised central ring 116B in socket head 116. The socket head 116 is a smoothed edge rectangular piece which has a raised central ring 116B designed with an opening 116A diameter to hold the ball 114 securely in place in a socket depression 118H in the golf head. The socket head 116 is attached to the top side 118E of the body 118 by two hexagonal screws 120 penetrating the socket head 116 adjacent to the raised central ring. One of the screws 120 penetrates the socket head 116 towards the toe of the head 118, and the other screw penetrates the socket head 116 towards the heel of the head 118.

Figure 32:
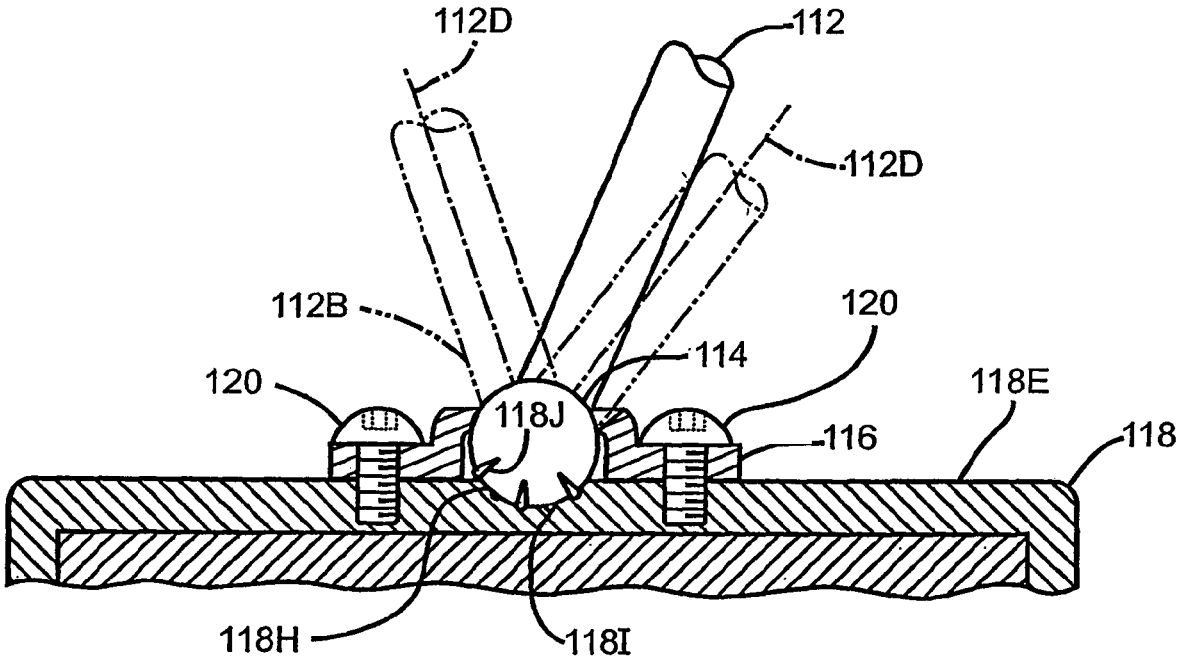
FIG. 32 is another embodiment showing a cross-section view of the golf putter head 93 of FIG. 29 taken along the line 31-31 of FIG. 29 with a ball 114 with teeth.

The ball 114 is thereby attached to the top side 118E of body 118 in socket depression 118B in the center of top side 118E, which allows the shaft to freely pivot along the toe to heel, or the front to back axis of the golf putter head away from the vertical. FIG. 30 illustrates a cross-section view of the golf putter of FIG. 29 taken along the plane indicated by 30-30 of FIG. 29 showing the inside surface threading 112C along the shaft axis and the threaded metal screw extension 114A of the ball 114 screwed into the inside threading 112C of distal end 112B of shaft 112. The FIG. 31 illustrates a cross-section view of the golf putter of FIG. 29 taken along the plane indicated by 31-31 of FIG. 29 which shows the completed ball and socket pivoting means. The shaft 112 with the ball 114 attached can be freely rotated with respect to the vertical in both toe to heel and front to back inclinations. The socket head 116 firmly holds the ball 114 and accordingly, the shaft 112 in place against the top side 118E of the head 118. FIG. 32 shows a more permanent mounting so that the putter will hold its position.

FIG. 32 illustrates a cross-section view of another embodiment of the golf putter of FIG. 29 taken along the plane indicated by 31-31 of FIG. 29 which shows the completed ball and socket pivoting means. The shaft 112 with the ball 114 with teeth 118J can be rotated with respect to the vertical in both toe to heel and front to back inclinations and securely held in a position. The socket head 116 firmly holds the ball 114 with teeth 118J in place in grooves 118I within socket depression 118H in the head 118.

FIGS. 33 and 34 illustrate a front view of another embodiment of a putter head 215 with sharp runners 218 which are semicircular and perpendicular to the bottom side 216F of the blade 216. Elongate flat blade 216 is a thin horizontal rectangle with distance from heel edge 216D to toe edge 216C (length) approximately twice the distance from front edge 216A to back edge 216B (width). The dimension ratios can vary, however the length is greater than the width by U.S.G.A. rules. The front edge 216A of blade 216 is the striking face which contacts the golf ball 20. A top side 216E of the elongate flat blade 216 is attached to the distal end 12B of shaft 12. Upon the opposite face of the blade 216 is the bottom side 216F. Two sharp runners 218 each with a semi-circular cross section are attached to the bottom side of the blade 216 near the toe edge 216C and heel edge 216D, with the front end 218C and back end 218D of each of the sharp runners 218 attached to the bottom side 216F of the blade 216. FIG. 34 illustrates a heel view of the golf putter head of FIG. 33 showing one of the sharp runners 218, and also showing distal end 12B of shaft 12 attached to face 216E near front edge 216A. Heel edge 216D of blade 216 is shown in foreground. Outermost sharp edge 218A of one of the sharp runners 218 attached near heel edge 216D of blade 216 is shown. The outermost sharp edge 218A of sharp runners 218 keep the blade 216 the proper distance from the putting surface, and allows for a smooth swinging movement during the stroke The putter heads 15, 32, 44, 51, 61, 75, 85, 93 and 215 described are of narrow width, while the body can be more conventional in size. The heads 15, 32, 44, 51, 61, 75, 85, 93 and 215 have a contact area between the blades 16, 36, 46, 56, 66, 76, 86, 96 and 216, and the golf ball 20 which are linear, and of narrow width. The contact area 24 on the golf ball 20 is horizontal in orientation. Additionally, the contact area 24 on the ball 20 usually spans the dimple 22 diameter. While not wishing to be held to any one theory, the contact area 24 allows the reduction in the release time of the ball from the front and thereby the ball starts rolling in less time. Additionally, the horizontal and linear contact area 24, geometry can create a dominant resultant direction of the ball to one plane, while with conventional putters the contact area (not shown) is circular which thereby allows for 360° of directional course tracking of the ball.

Another aspect of the putter is that the shaft 12 is attached directly to the elongate flat blades 16, 36, 46, 56, 66, 76, and 86, at or near the area of anticipated contact of the blade 16, 36, 46, 56, 66, 76, 86 and 216, to the ball 20. This is in contrast to the typical putter which has a connection at some distance from the contact site where it is attached to some part of the body of the putter. This customary connection requires the force of impact to travel through the mass of the club head material prior to entering the shaft of the putter, thus reducing the feel of the contact. The elongate flat blade putter heads 15, 32, 44, 51, 61, 75, 85 and 215 intimate connection to the anticipated site of contact produces faster transmission of force of the impact to the golfer's hands. This produces an improved "feel" which is an important component of putting proficiency. This feature will be visibly evident on some models of the elongate flat putter by creating a circumferential space between the mass of the putter head and the shaft of the putter giving the appearance of being countersunk.

The surrounding body 34, 64, 94, and 118, or arching top 53 is predominantly cosmetic to provide a variety of appearances. This is an important aspect of putter design. However, there are many potential functions of the body 34, 64, 94, and 118, or arching top 53. First, the body 34, 64, 94, and 118, or arching top 53 provides a potential for various weights to meet the individual golfer's preferences. Second, the body 34, 64, 94, and 118, or arching top 53 provides various positions to position the head weight to optimize the linear nature of the horizontal contact. Third, the weight of the putter head is transmitted to a horizontal narrow striking area by adjusting the center of gravity. Fourth, the body 34, 64, 94, and 118 provides the opportunity to create the optimal distance between the ground and the best possible striking area on the golf ball. This distance can be varied to accommodate the various swing planes created by different golfer's strokes, i.e. direct, up, down, in, out, etc. Additionally, the body 34, 64, 94, and 118, or arching top 53 will accommodate alignment lines or graphics.

A shaft 12, 112 can be of any type, including a "belly putter" type (not shown), which is longer than a traditional putter, and allows for a style of putting where the proximal end of the putter is stabilized on the player's belly. In some embodiments, the shaft 12, 112 can be of a long putter type (not shown). In some embodiments, the shaft 12, 112 is of a traditional short length, at least longer than approximately 18 inches (457 mm). In further still embodiments, the shaft 12, 112 is relatively long (not shown), which makes it ideal for a pendulum style of golf stroke.

It is anticipated that modular systems could be provided to assist in obtaining the optimal positioning prior to finalization of the manufacture and for fitting. The modular elongate flat blade could be secured to the front of existing putters as a straightening device or more permanently in accordance with U.S.G.A. rules for competitive play. The geometry and the narrow front require the most perfect putting stroke by the golfer. That issue is readily recognized. Therefore, the golfer takes more care to create the improved stroke in order to make smooth and precise contact with the ball 20. This aspect results in self-tutorial on improving the golfer's putting stroke and therefore improves his game. This feature also can be exploited as a training device.

EXAMPLE

A golf putter 10 was constructed using a commercially available shaft 12 and grip 14. The head 15 was constructed as illustrated in FIGS. 2-5. The putter blade 16 and runner 18 were constructed from steel plate. The top side 16E of the flat blade 16 was welded to the distal end of a chromed steel shaft 12. Upon the bottom side 16F of the blade 16 a steel runner 18 was welded to the bottom side of the blade. Another golf putter was constructed using a commercially available shaft 12 and grip 14. The head 32 as illustrated in FIGS. 10-12 was constructed by embedding a steel blade 36 in a solid rectangular wooden block which served as the putter body 34. The distal end of the shaft 12 penetrated the top surface 34E of the body 34 and was welded to the top side 36E of the blade 36.

Figure 7A:
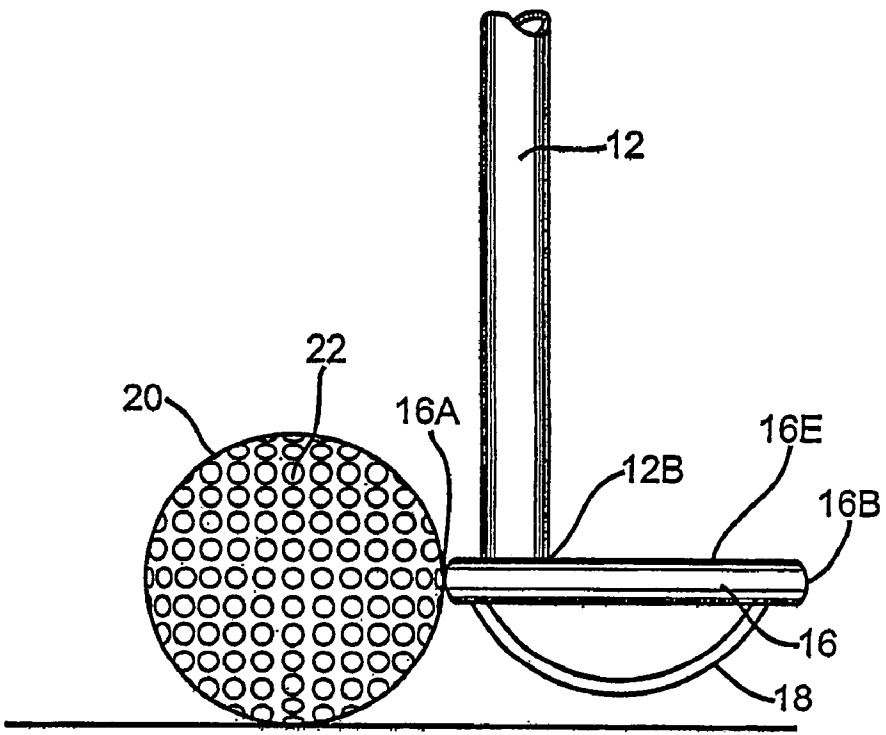
FIG. 7A illustrates a heel view of the golf putter head 15 of FIG. 2 in contact with a golf ball 20.
Figure 7B:
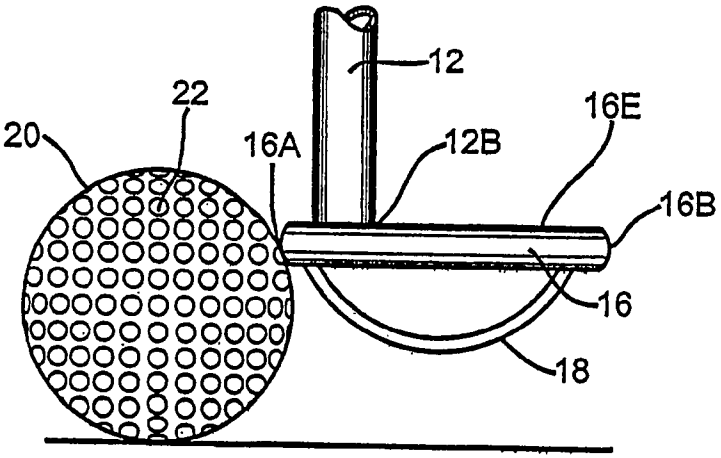
FIG. 7B illustrates a heel view of the golf putter head 15 of FIG. 2 in off-center contact with a golf ball 20.
Figure 7C:
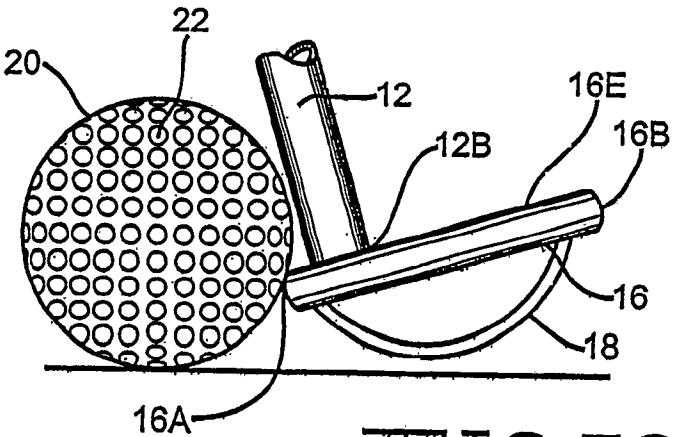
FIG. 7C illustrates a heel view of the golf putter head 15 of FIG. 2 in downward angle of approach to a golf ball 20.
Figure 7D:
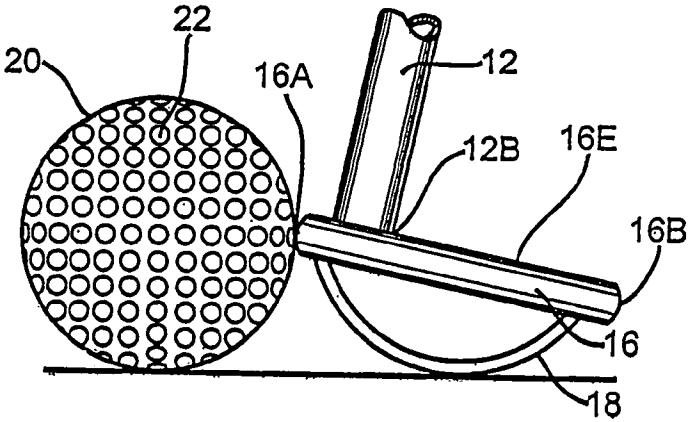
FIG. 7D illustrates a heel view of the golf putter head 15 of FIG. 2 in upward angle of approach to a golf ball 20.

Putting with a conventional putter or one with a round surface produced a circular area of contact on the putter and ball, while putting with a sand iron has the potential to create a horizontal linear pattern of contact on the blade and the ball 20. Putting with the elongate flat blade putter head 15, 32 created a contact area 24 on the ball which was horizontal and linear. The stroke feel was great, and distance control was surprising. The geometry of the elongate flat blade 16, 36, 46, 56, 66, 76, 86, 96 and 216 allows for various angles of approach and positions of contact (FIGS. 7A-7C). The elongate flat blade 16, 36, 46, 56, 66, 76, 86, 96 and 216 can strike the ball 20 along the center of the ball 20 (FIG. 7A) or off-center of the ball 20 (FIG. 7B). The angle of approach allows control of roll of the ball 20. Striking the ball 20 in upward (FIG. 7D) or downward (FIG. 7C) angles of approach resulted in straight tracking of the ball, especially when compared to conventional putters. There was surprisingly little bounce when striking the ball 20 in upward (FIG. 7B) or downward (FIG. 7D) angles of approach. The putter 10 worked well off the fringe of the green. For some golfers, there was a smoother roll when a forward press was used.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the Claims attached herein.

I claim:

1. A golf putter having a shaft with a grip at a proximal end and a head at a distal end of the shaft for contacting a golf ball on the ground during putting of the golf ball, the improvement in the head which comprises:

an elongate flat blade having opposed ends, with a top side and a bottom side, and a first linear edge extending therebetween, wherein the top side of the blade is mounted on the distal end of the shaft and the first linear edge acts as a striking face for the golf ball and strikes the golf ball in an essentially linear contact area horizontal to the ground, wherein only a single groove extends along a length of the striking face, wherein said only a single groove is horizontal to the ground when said first linear edge is horizontal to the ground and said bottom side is facing the ground, and wherein the striking face is less than 0.25 inch (6.4 mm) thick between the sides defining the first linear edge.

2. The putter of claim 1 wherein the striking face is curved with a radius of curvature less than a radius of the golf ball.

3. A golf putter having a shaft with a grip at a proximal end and a head at a distal end of the shaft for contacting a golf ball on the ground during putting of the golf ball, the improvement in the head which comprises:

(a) an elongate flat blade having opposed ends, with a top side and a bottom side, and a first linear edge extending therebetween, wherein the top side of the blade is mounted on the distal end of the shaft and the first linear edge acts as a striking face for the golf ball and strikes the golf ball in an essentially linear contact area horizontal to the ground, wherein only a single groove extends along a length of the striking face, wherein said only a single groove is horizontal to the ground when said first linear edge is horizontal to the ground and said bottom side is facing the ground, and wherein the striking face is less than 0.25 inch (6.4 mm) thick between the sides defining the first linear edge; and (b) a runner provided on the bottom side of the blade wherein during putting, the runner acts to space the bottom side of the blade from the ground.

4. The putter of claim 3 wherein the runner extends between the first linear edge and a second linear edge, and is convexly rounded between the linear edges.

5. The putter of claim 3, wherein the shaft of the putter is mounted to the top side of the blade adjacent to the first linear edge where the edge strikes the ball.

6. The putter of claim 3, wherein the striking face is curved with a radius of curvature less than a radius of the golf ball.

7. The putter of claim 3, wherein the striking face is capable of striking the golf ball at, above, or below a median of the golf ball.

* * * * *